US008371690B2

(12) United States Patent
Takatsuka

(10) Patent No.: US 8,371,690 B2
(45) Date of Patent: Feb. 12, 2013

(54) IMAGE FORMING APPARATUS AND IMAGE FORMING METHOD

(75) Inventor: Tsutomu Takatsuka, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 634 days.

(21) Appl. No.: 12/475,148

(22) Filed: May 29, 2009

(65) Prior Publication Data

US 2009/0295898 A1 Dec. 3, 2009

(30) Foreign Application Priority Data

May 30, 2008 (JP) ..... 2008-142779

(51) Int. Cl.
*B41J 2/01* (2006.01)

(52) U.S. Cl. ..... 347/104

(58) Field of Classification Search ..... 347/102, 347/104

See application file for complete search history.

(56) References Cited

U.S. PATENT DOCUMENTS

| | | | | |
|---|---|---|---|---|
| 2005/0110857 | A1 | 5/2005 | Matsumoto et al. | |
| 2006/0071990 | A1 | 4/2006 | Hirakawa | |
| 2009/0231407 | A1 * | 9/2009 | Kachi | 347/104 |

FOREIGN PATENT DOCUMENTS

| | | | |
|---|---|---|---|
| JP | 10-175338 | A | 6/1998 |
| JP | 2004-291627 | A | 10/2004 |
| JP | 2005-75475 | A | 3/2005 |
| JP | 2006-88578 | A | 4/2006 |

OTHER PUBLICATIONS

Japanese Office Action dated Jun. 14, 2012 issued in corresponding Japanese Patent Application No. 2008-142779 (English translation is attached).

* cited by examiner

*Primary Examiner* — Matthew Luu
*Assistant Examiner* — Renee I Wilson
(74) *Attorney, Agent, or Firm* — Birch, Stewart, Kolasch & Birch, LLP

(57) ABSTRACT

An image forming apparatus has: a first conveyance device having a plurality of first suction holes; a treatment liquid deposition device; a second conveyance device which is provided downstream of the first conveyance device in terms of a conveyance direction in which the recording medium is conveyed; and an image forming device, wherein the first suction holes of the first conveyance device and the second suction holes of the second conveyance device are formed in such a manner that first suction positions on the recording medium which are suctioned by the first suction holes of the first conveyance device and second suction positions on the recording medium which are suctioned by the second suction holes of the second conveyance device are mutually different.

6 Claims, 28 Drawing Sheets

110
12
12
124
124
124
PAPER CONVEYANCE DIRECTION
EDGE PORTION
EDGE PORTION
EDGE PORTION
EDGE PORTION 310
12
12
324
324
PAPER CONVEYANCE DIRECTION

110 + 310
12
12
124
324
124
324
124
PAPER CONVEYANCE DIRECTION

FIG.26

| ITEM | | (AREA OF OVERLAPPED PORTION) / (AREA OF POTENTIAL IMAGE FORMATION SURFACE AREA) × 100 [%] | | | | | |
|---|---|---|---|---|---|---|---|
| | | 0 | 1 | 2 | 3 | 4 | 5 |
| (AREA OF OVERLAPPED PORTION) / (AREA OF LARGER SUCTION HOLE) × 100 [%] | 0 | Excellent | - | - | - | - | - |
| | 5 | - | Excellent | Excellent | Good | Average | Poor |
| | 10 | - | Good | Good | Good | Average | Poor |
| | 15 | - | Good | Good | Good | Average | Poor |
| | 20 | - | Average | Average | Average | Average | Poor |
| | 25 | - | Poor | Poor | Poor | Poor | Poor |

IMAGE FORMING APPARATUS AND IMAGE FORMING METHOD

BACKGROUND OF THE INVENTION

1. Field of the Invention

The present invention relates to an image forming apparatus and an image forming method, and more particularly to an image forming apparatus and an image forming method of forming an image by ejecting droplets of ink after depositing a treatment liquid which aggregates or insolubilizes the ink onto the front surface of a recording medium.

2. Description of the Related Art

In an inkjet recording apparatus which forms an image on a recording medium by ejecting droplets of ink, problems such as feathering or bleeding occur when an image is formed on so-called normal paper.

Therefore various technologies for preventing the occurrence of feathering or bleeding have been proposed. One of these is a known method of forming an image by ejecting ink droplets after previously depositing a treatment liquid which aggregates or insolubilizes ink onto the front surface of paper. This method insolubilizes the coloring material and/or raises the viscosity by causing a reaction of some kind with the ink, but the insoluble material or raised viscosity components arising from this reaction remain on the front surface of the paper and this gives rise to problems, for instance, the density distribution of the recorded image becomes non-uniform, or permeation into the paper of the solvent or water contained in the ink is obstructed and hence the fixing time of the image becomes long.

Therefore, as a method for resolving this problem, Japanese Patent Application Publication No. 2004-291627 discloses a method in which paper is conveyed while being suctioned on a conveyance belt in which suction holes (air holes) are formed, treatment liquid is deposited onto the paper suctioned and conveyed on the conveyance belt by a treatment liquid deposition device, and ink is then deposited from a recording head.

If paper is suctioned during conveyance as in Japanese Patent Application Publication No. 2004-291627, the paper is recessed in the portions corresponding to the suction holes, and if treatment liquid is deposited by application with a roller, or the like, the treatment liquid moves to these recess portions (recesses), and is liable to collect there. Furthermore, if treatment liquid is deposited by ejection from a recording head, or the like, there is a possibility that deviation occurs in the depositing positions at the recess portions. Furthermore, since the suctioning force in the portions corresponding to the suction holes is stronger than in other portions, the permeation of treatment liquid is accelerated at the perimeter of the suction holes only, and as a result of this, non-uniformity occurs in the treatment liquid density, and hence image non-uniformities arise.

Problems of this kind can be eliminated to a certain degree by adjusting the suctioning force during suction and conveyance, but if the paper is conveyed on the same conveyance belt from the deposition of treatment liquid until the deposition of ink and ink deposition is carried out consecutively following the deposition of treatment liquid, as in Japanese Patent Application Publication No. 2004-291627, then the deposition non-uniformities of the treatment liquid and the deposition non-uniformities of the ink are mutually superimposed (the non-uniformities due to the suctioning force are doubled) and therefore the image non-uniformities become worse.

SUMMARY OF THE INVENTION

The present invention has been contrived in view of these circumstances, an object thereof being to provide an image forming apparatus and an image forming method whereby image non-uniformities can be reduced.

In order to attain an object described above, one aspect of the present invention is directed to an image forming apparatus, comprising: a first conveyance device which includes a first suctioning surface traveling and having a plurality of first suction holes, places a recording medium in a first prescribed position on the first suctioning surface, and conveys the recording medium in the first prescribed position on the first suctioning surface while suctioning a rear surface of the recording medium via the plurality of first suction holes; a treatment liquid deposition device which deposits a treatment liquid that aggregates or insolubilizes coloring material of an ink onto a front surface of the recording medium conveyed by the first conveyance device; a second conveyance device which is provided downstream of the first conveyance device in terms of a conveyance direction in which the recording medium is conveyed, includes a second suctioning surface traveling and having a plurality of second suction holes, places the recording medium in a second prescribed position on the second suctioning surface, and conveys the recording medium in the second prescribed position on the second suctioning surface while suctioning the rear surface of the recording medium via the plurality of second suction holes; and an image forming device which ejects droplets of the ink onto the front surface of the recording medium conveyed by the second conveyance device so as to form an image, wherein the first suction holes of the first conveyance device and the second suction holes of the second conveyance device are formed in such a manner that first suction positions on the recording medium which are suctioned by the first suction holes of the first conveyance device and second suction positions on the recording medium which are suctioned by the second suction holes of the second conveyance device are mutually different.

According to this aspect of the invention, an image is formed by depositing treatment liquid on the front surface of a recording medium while suctioning and conveying the recording medium by means of a first conveyance device and then ejecting ink droplets onto the front surface of the recording medium while suctioning and conveying the recording medium by means of a second conveyance device. A recording medium is placed in a prescribed position on a traveling suctioning surface of the first conveyance device, which conveys the recording medium while suctioning the rear surface of the recording medium via a plurality of suction holes formed in the suctioning surface. In a similar fashion, a recording medium is placed in a prescribed position on a traveling suctioning surface of the second conveyance device, which conveys the recording medium while suctioning the rear surface of the recording medium via a plurality of suction holes formed in the suctioning surface. The suction holes formed in the suctioning surface of the first conveyance device and the suction holes formed in the suctioning surface of the second conveyance device are formed by adjusting their position, size, shape, and the like, in such a manner that they respectively suction different positions on the recording medium. In other words, the suction holes of the first conveyance device and the suction holes of the second conveyance device are formed by adjusting their position, size, shape, and the like, in such a manner that the positions where the suction holes make contact with the recording medium during the deposition of treatment liquid, and the positions where the suction holes make contact with the recording medium during the deposition of ink are mutually different. By this means, it is possible to reduce image non-uniformities caused by non-uniformities in the reaction between the treatment liquid and the ink. In other words, if both the treatment liquid and the ink are deposited in consecutive fashion onto a recording medium while suctioning the medium from suction holes at the same positions, then the deposition non-uniformities of the treatment liquid and the deposition non-uniformities of the ink are superimposed on each other, and image non-uniformity becomes worse, but by separating the conveyance device during the deposition of treatment liquid (first conveyance device) and the conveyance device during the deposition of ink (second conveyance device), and staggering the positions where suction holes suction the recording medium during deposition of treatment liquid with respect to the positions where suction holes suction the recording medium during deposition of ink, it is possible to prevent mutual superimposition of the deposition non-uniformities of the treatment liquid and the deposition non-uniformities of the ink, and therefore image non-uniformities caused by non-uniformities in the reaction can be reduced.

In order to attain an object described above, another aspect of the present invention is directed to an image forming apparatus, comprising: a first conveyance device which includes a first suctioning surface traveling and having a plurality of first suction holes, places a recording medium in a first prescribed position on the first suctioning surface, and conveys the recording medium in the first prescribed position on the first suctioning surface while suctioning a rear surface of the recording medium via the plurality of first suction holes; a treatment liquid deposition device which deposits a treatment liquid that aggregates or insolubilizes coloring material of an ink, onto a front surface of the recording medium conveyed by the first conveyance device; a second conveyance device which is provided downstream of the first conveyance device in terms of a conveyance direction in which the recording medium is conveyed, includes a second suctioning surface traveling and having a plurality of second suction holes, places the recording medium in a second prescribed position on the second suctioning surface, and conveys the recording medium in the second prescribed position on the second suctioning surface while suctioning the rear surface of the recording medium via the plurality of second suction holes; and an image forming device which ejects droplets of the ink onto the front surface of the recording medium conveyed by the second conveyance device so as to form an image, wherein first suction positions on the recording medium which are suctioned by the first suction holes of the first conveyance device and second suction positions on the recording medium which are suctioned by the second suction holes of the second conveyance device include an overlapping portion in which the first suction positions and the second suction positions partially overlap with each other so as to satisfy a condition that a ratio of area of the overlapping portion with respect to area of larger ones of the first suction holes and the second suction holes is equal to or lower than 20% and a ratio of the area of the overlapping portion with respect to a potential image formation area of the recording medium is equal to or lower than 4%.

As described above, in order to reduce image non-uniformities caused by non-uniformities in the treatment liquid, if deposition of treatment liquid and deposition of ink are carried out while suctioning and conveying the recording medium, then it is desirable that the positions where the suction holes suction the recording medium during the deposition of treatment liquid and the positions where the suction holes suction the recording medium during the deposition of ink should be completely staggered with respect to each other, but even if they are partially overlapping, similar beneficial effects can be obtained. This aspect of the present invention specifies conditions whereby a beneficial effect in reducing image non-uniformities can be obtained, even if the positions where the suction holes suction the recording medium during the deposition of treatment liquid and the positions where the suction holes suction the recording medium during the deposition of ink are partially overlapping in this way. In other words, in a case in which the suction positions where the suction holes of the first conveyance device suction the recording medium and the suction positions where the suction holes of the second conveyance device suction the recording medium are partially overlapping, then it is possible to reduce image non-uniformities arising from reaction non-uniformities by simultaneously satisfying the following two conditions in the respective overlapped portions:(1) the ratio of the surface area of the overlapped portion with respect to the surface area of the larger suction hole is 20% or less ([surface area of overlapped portion/surface area of larger suction hole]×100%≦20%), and (2) the ratio of the surface area of the overlapped portion with respect to the potential image formation surface area on the recording medium is 4% or less ([surface area of overlapped portion/potential image formation surface area on the recording medium]×100%≦4%.

Desirably, the first conveyance device and the second conveyance device each have a gripping device which grips an end of the recording medium.

According to this aspect of the invention, the first conveyance device and the second conveyance device respectively have a gripping device which grips the leading end of the recording medium, and the recording medium is suctioned and conveyed while the leading end in the conveyance direction is gripped by this gripping device. Consequently, it is possible to achieve more stable conveyance of the recording medium.

Desirably, suctioning force acting via the second suction holes of the second conveyance device is set to be higher than suctioning force acting via the first suction holes of the first conveyance device.

According to this aspect of the invention, the suctioning force acting via the suction holes of the second conveyance device (the suctioning force during deposition of ink) is set to be higher than the suctioning force acting via the suction holes of the first conveyance device (the suctioning force during deposition of treatment liquid). In other words, the suctioning force during the deposition of treatment liquid is set to be smaller than the suctioning force during the deposition of ink. By this means, it is possible to prevent the recording medium from making contact with the recording head, and therefore the ratio of jams can be reduced. In other words, since the clearance between the recording head which ejects ink droplets and the suctioning surface of the second conveyance device is extremely narrow and the recording medium after the deposition of treatment liquid undergoes deformation upon drying, then by suctioning and holding the medium reliably by means of a strong suctioning force, the medium is prevented from coming into contact with the recording head and therefore the ratio of jams can be reduced.

In order to attain an object described above, another aspect of the present invention is directed to an image forming method, comprising the steps of: placing a recording medium on a first suctioning surface traveling and having a plurality of first suction holes, and conveying the recording medium on the first suctioning surface while suctioning a rear surface of the recording medium via the plurality of first suction holes; depositing a treatment liquid that aggregates or insolubilizes coloring material of an ink, onto a front surface of the recording medium conveyed by the first suctioning surface; placing the recording medium on which the treatment liquid is deposited, on a second suctioning surface traveling and having a plurality of second suction holes, and conveying the recording medium on the second suctioning surface while suctioning the rear surface of the recording medium via the plurality of second suction holes; and ejecting droplets of the ink onto the front surface of the recording medium conveyed on the second suctioning surface so as to form an image, wherein first suction positions of the recording medium which are suctioned by the first suction holes of the first suctioning surface and second suction positions of the recording medium which are suctioned by the second suction holes of the second suctioning surface are mutually different.

According to this aspect of the invention, similarly to the above-described aspect of the invention, by staggering the suction positions on the recording medium which are suctioned by the suction holes of the first suctioning surface (the suction positions during the deposition of treatment liquid) and the suction positions on the recording medium which are suctioned by the suction holes of the second suctioning surface (the suction positions during the deposition of ink), it is possible to reduce effectively the occurrence of image non-uniformities caused by non-uniformities in the deposition of the treatment liquid and non-uniformities in the deposition of the ink.

In order to attain an object described above, another aspect of the present invention is directed to an image forming method, comprising the steps of: placing a recording medium on a first suctioning surface traveling and having a plurality of first suction holes, and conveying the recording medium on the first suctioning surface while suctioning a rear surface of the recording medium via the plurality of first suction holes; depositing a treatment liquid that aggregates or insolubilizes coloring material of an ink, onto a front surface of the recording medium conveyed by the first suctioning surface; placing the recording medium on which the treatment liquid is deposited, on a second suctioning surface traveling and having a plurality of second suction holes, and conveying the recording medium on the second suctioning surface while suctioning the rear surface of the recording medium via the plurality of second suction holes; and ejecting droplets of the ink onto the front surface of the recording medium conveyed on the second suctioning surface so as to form an image, wherein first suction positions on the recording medium which are suctioned by the first suction holes of the first suctioning surface and second suction positions on the recording medium which are suctioned by the second suction holes of the second suctioning surface include an overlapping portion in which the first suction positions and the second suction positions partially overlap with each other so as to satisfy a condition that a ratio of area of the overlapping portion with respect to area of larger ones of the first suction holes and the second suction holes is equal to or lower than 20% and a ratio of the area of the overlapping portion with respect to a potential image formation area of the recording medium is equal to or lower than 4%.

According to this aspect of the invention, similarly to the above-described aspect of the invention, even in cases where there is partial overlapping of the suction positions on the recording medium which are suctioned by the suction holes of the first suctioning surface (the suction positions during the deposition of treatment liquid) and the suction positions on the recording medium which are suctioned by the suction holes of the second suctioning surface (the suction positions during the deposition of ink), by satisfying prescribed conditions in the overlapped portions, it is possible to reduce effectively image non-uniformities caused by non-uniformities in the reaction between the treatment liquid and the ink.

Desirably, when the recording medium is placed and conveyed on the first suctioning surface, the recording medium is conveyed while being gripped at an end of the recording medium; and when the recording medium is placed and conveyed on the second suctioning surface, the recording medium is conveyed while being gripped at an end of the recording medium.

According to this aspect of the invention, similarly to the above-described aspect of the invention, more stable conveyance becomes possible by suctioning and conveying the recording medium while gripping the leading end of the recording medium in the conveyance direction.

Desirably, suctioning force acting via the second suction holes of the second suctioning surface is set to be higher than suctioning force acting via the first suction holes of the first suctioning surface.

According to this aspect of the invention, similarly to the above-described aspect of the invention, it is possible to reduce the ratio of jams by setting the suctioning force acting via the suction holes of the second conveyance device to be stronger than the suctioning force acting via the suction holes of the first conveyance device.

According to the present invention, it is possible to reduce image non-uniformities in cases where the deposition of treatment liquid and the deposition of ink are carried out while suctioning and conveying the recording medium.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 26 is a table illustrating the results of visual evaluation of image non-uniformities when images were formed while varying the conditions of overlap of the suction positions;

DETAILED DESCRIPTION OF THE PREFERRED EMBODIMENTS

Figure 1:
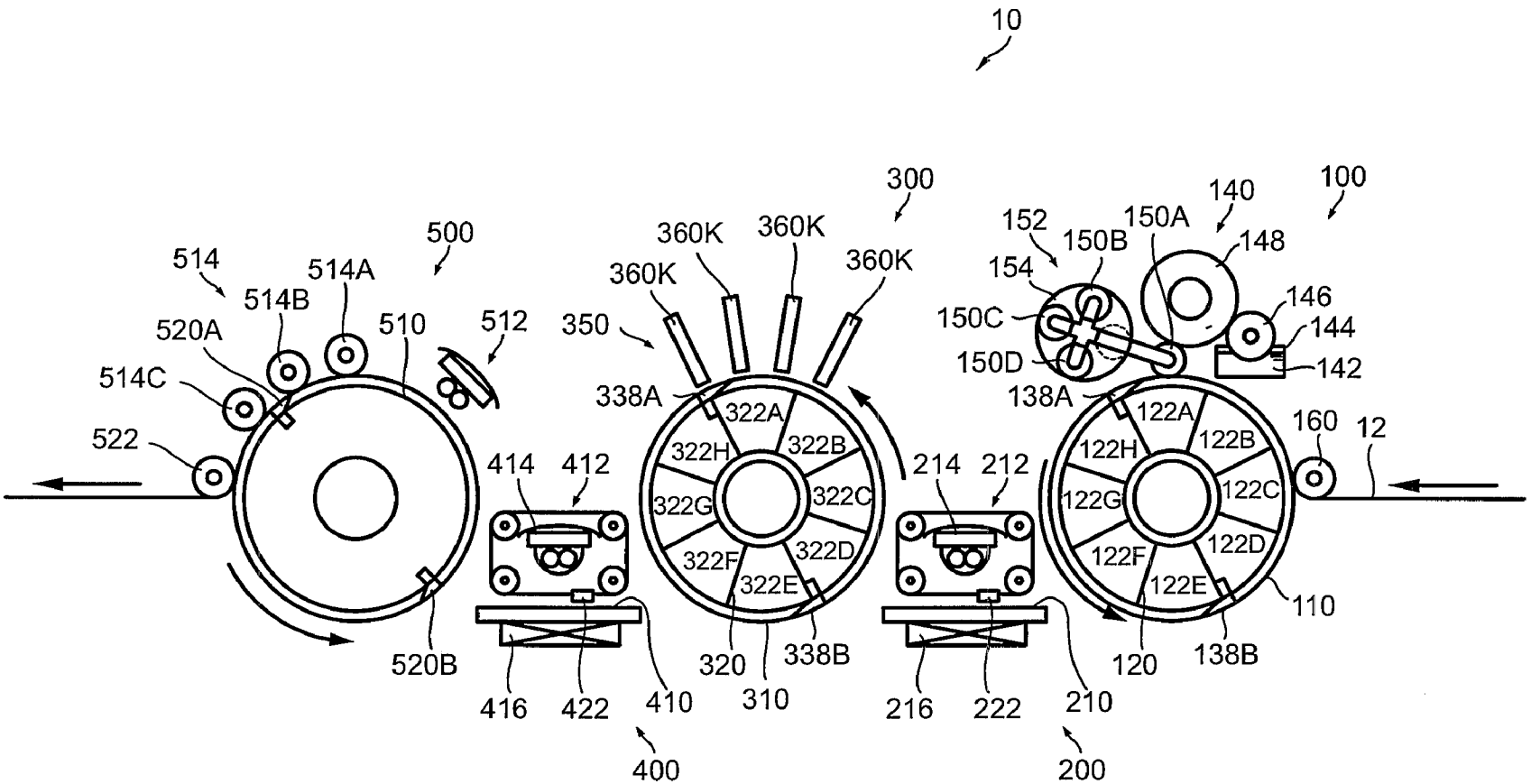
FIG. 1 is an approximate schematic drawing illustrating one embodiment of an image forming apparatus relating to an embodiment of the present invention.

FIG. 1 is an approximate schematic drawing illustrating one embodiment of an image forming apparatus relating to an embodiment of the present invention. This image forming apparatus 10 is an inkjet recording apparatus which previously deposits a treatment liquid that aggregates or insolubilizes ink onto the front surface of recording paper (recording medium), whereupon color inks are ejected from the recording head thereby forming a color image, and this image forming apparatus 10 principally comprises: a treatment liquid deposition unit 100 which deposits treatment liquid onto the front surface of the recording paper 12; a treatment liquid drying unit 200 which dries the treatment liquid thus deposited; a color ink deposition unit 300 which forms an image by depositing color inks onto the front surface of the recording paper 12 on which the treatment liquid has dried; a solvent drying unit 400 which dries the ink solvent remaining on the front surface of the recording medium 12 on which the color inks have been deposited; and a fixing unit 500 which fixes the resin component contained in the ink aggregate onto the recording paper 12.

Treatment Liquid Deposition Unit

The recording paper 12 is constituted by cut paper which has been cut to a prescribed size, and is supplied one sheet at a time from a paper supply unit, which is not illustrated. Treatment liquid which aggregates or insolubilizes the ink is deposited onto the front surface of the recording paper 12 supplied from the paper supply unit, while the paper is suctioned and conveyed in the treatment liquid deposition unit 100. The treatment liquid deposition unit 100 comprises a suction drum 110 which suctions and conveys the recording paper 12, and an application unit 140 which applies treatment liquid to the front surface of the recording paper 12 which is suctioned and conveyed by the suction drum 110.

The suction drum 110 suctions and holds the rear surface of the recording paper 12 placed on the outer circumferential surface (suctioning surface) thereof by suctioning air via the suction holes formed on the outer circumferential surface, and the drum is rotated by driving a rotational drive device (for example, a motor) (not illustrated in figures), whereby the paper 12 suctioned and held on the outer circumferential surface is conveyed following a prescribed conveyance path (a circular arc-shaped conveyance path).

Figure 2:
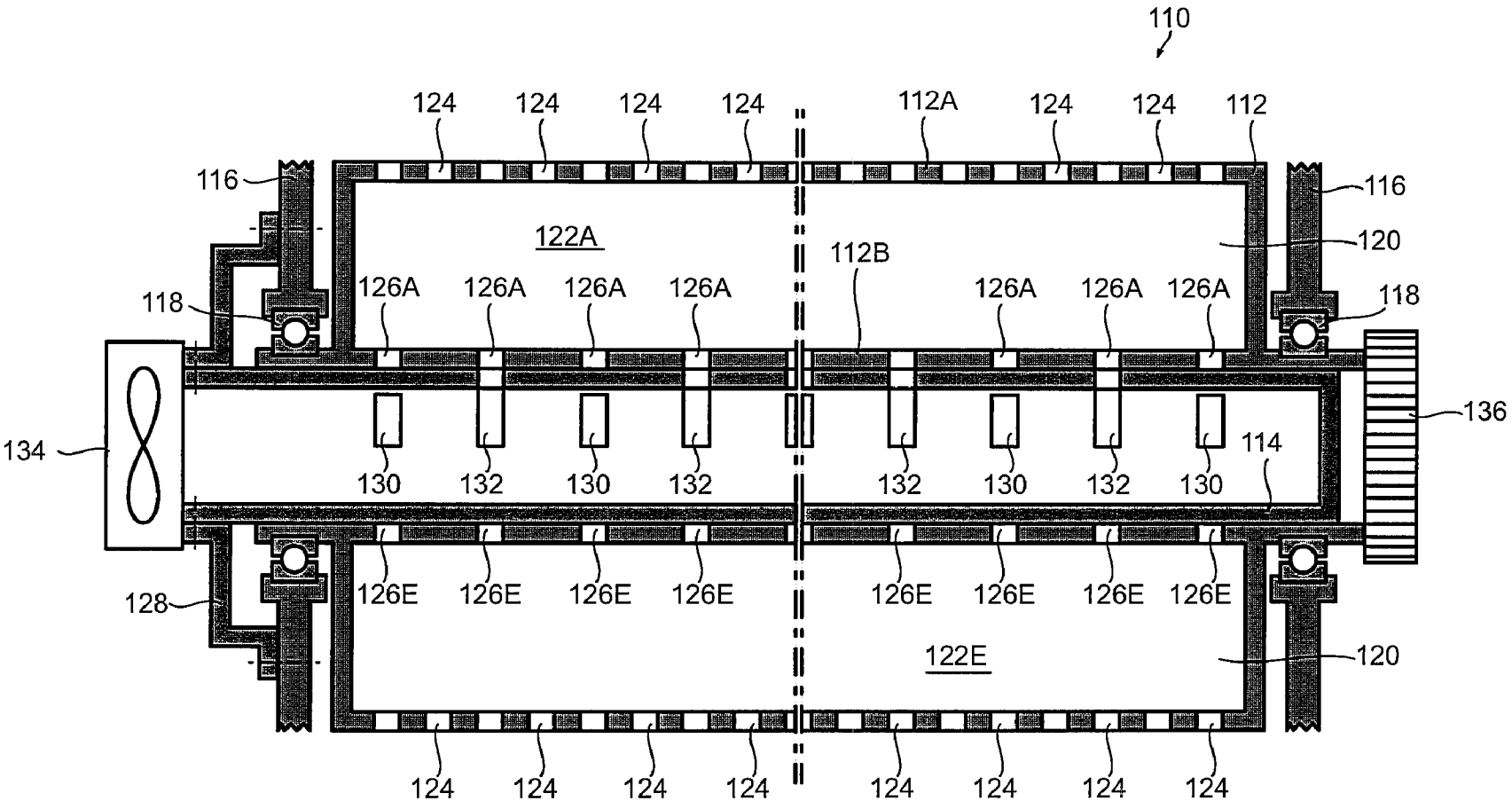
FIG. 2 is a front view cross-sectional diagram illustrating the approximate composition of a suction drum of a treatment liquid deposition unit.
Figure 3:
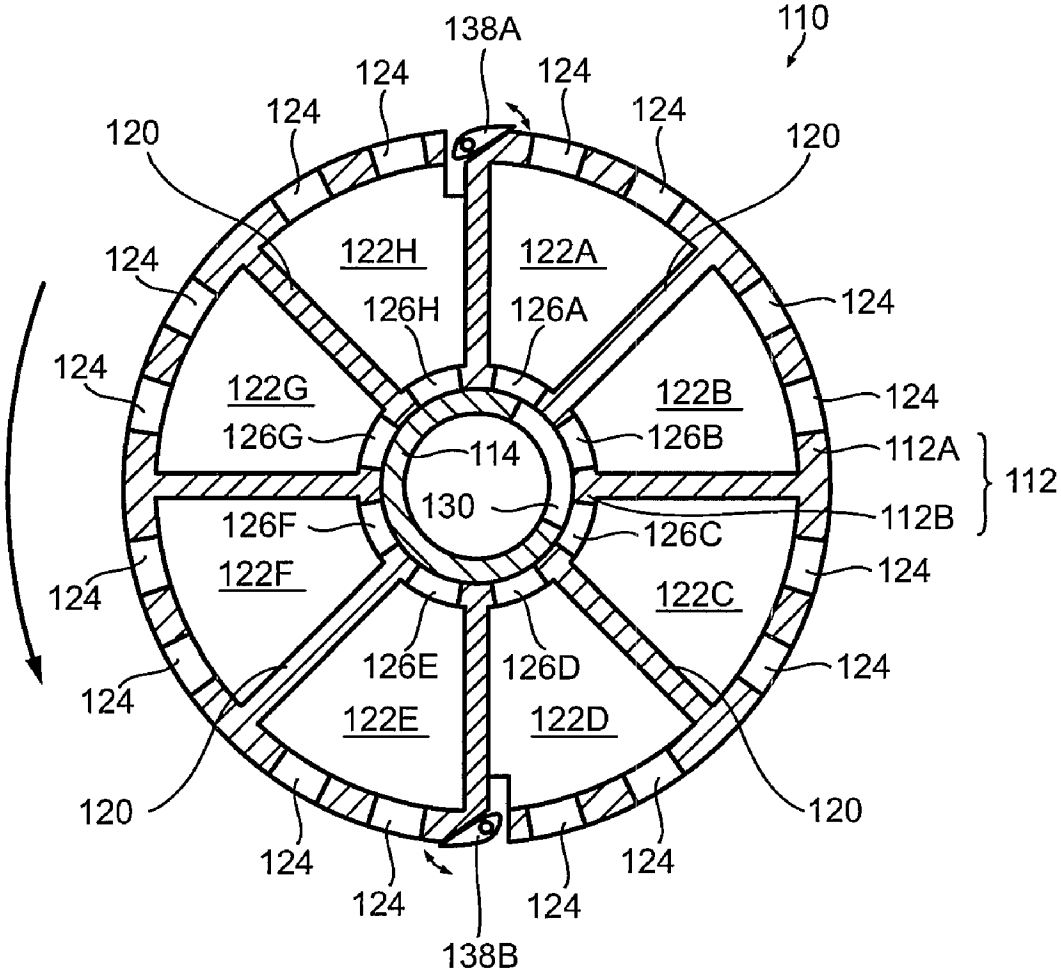
FIG. 3 is a side view cross-sectional diagram illustrating the approximate composition of a suction drum of a treatment liquid deposition unit.

FIGS. 2 and 3 are a front view cross-sectional diagram and a side view cross-sectional diagram illustrating the approximate composition of the suction drum 110. As illustrated in FIG. 2 and FIG. 3, the suction drum 110 is constituted by a suction drum main body 112 composed with a dual-tube structure comprising an outer tube 112A and an inner tube 112B, and an axle tube 114 which is inserted into the inner circumferential portion of the inner tube 112B of the suction drum main body 112.

The outer tube 112A of the suction drum main body 112 is formed in a round cylindrical shape which is closed at either end, and is formed to a width corresponding to the maximum-size recording paper 12 handled by the image forming apparatus 10 (namely, to a width greater than the width of the recording paper of the maximum size).

The inner tube 112B of the suction drum main body 112 is disposed coaxially with the inner circumferential section of the outer tube 112A and either end section thereof is formed so as to extend beyond the respective ends of the outer tube 112A. The suction drum main body 112 is supported rotatably by axially supporting both end portions of the inner tube 112B, which are formed so as to extend beyond the respective ends of the outer tube 112A, via bearings 118 on brackets 116 which are provided on a main body frame (not illustrated) of the image forming apparatus 10. A gear 136 is provided on one end of the inner tube 112B (the right-hand end in FIG. 2), rotational force is transmitted to this gear 136 from a rotational drive device (for example, a motor), which is not illustrated, and the suction drum main body 112 is thereby rotated (in leftward rotation in FIG. 3 (the counter-clockwise direction)).

The internal space of the suction drum main body 112 (the space between the inner tube 112B and the outer tube 112A) is divided into eight spaces 122A to 122H in the circumferential direction, by means of dividing partitions 120 which are disposed in a radiating fashion at intervals of 45 degrees between the inner tube 112B and the outer tube 112A.

The outer circumferential surface of the outer tube 112A constitutes a suctioning surface for the recording paper 12, and a plurality of suction holes 124 passing through to the internal space of the suction drum main body 112 are formed in a prescribed pattern in this surface. The recording paper 12 which is placed on the outer circumferential surface of the outer tuber 112A is suctioned and held on the outer circumferential surface of the outer tube 112A by being suctioned via these suction holes 124. The pattern in which the suction holes 124 are formed on the outer circumferential surface of the outer tube 112A is described in detail below.

Figure 4:
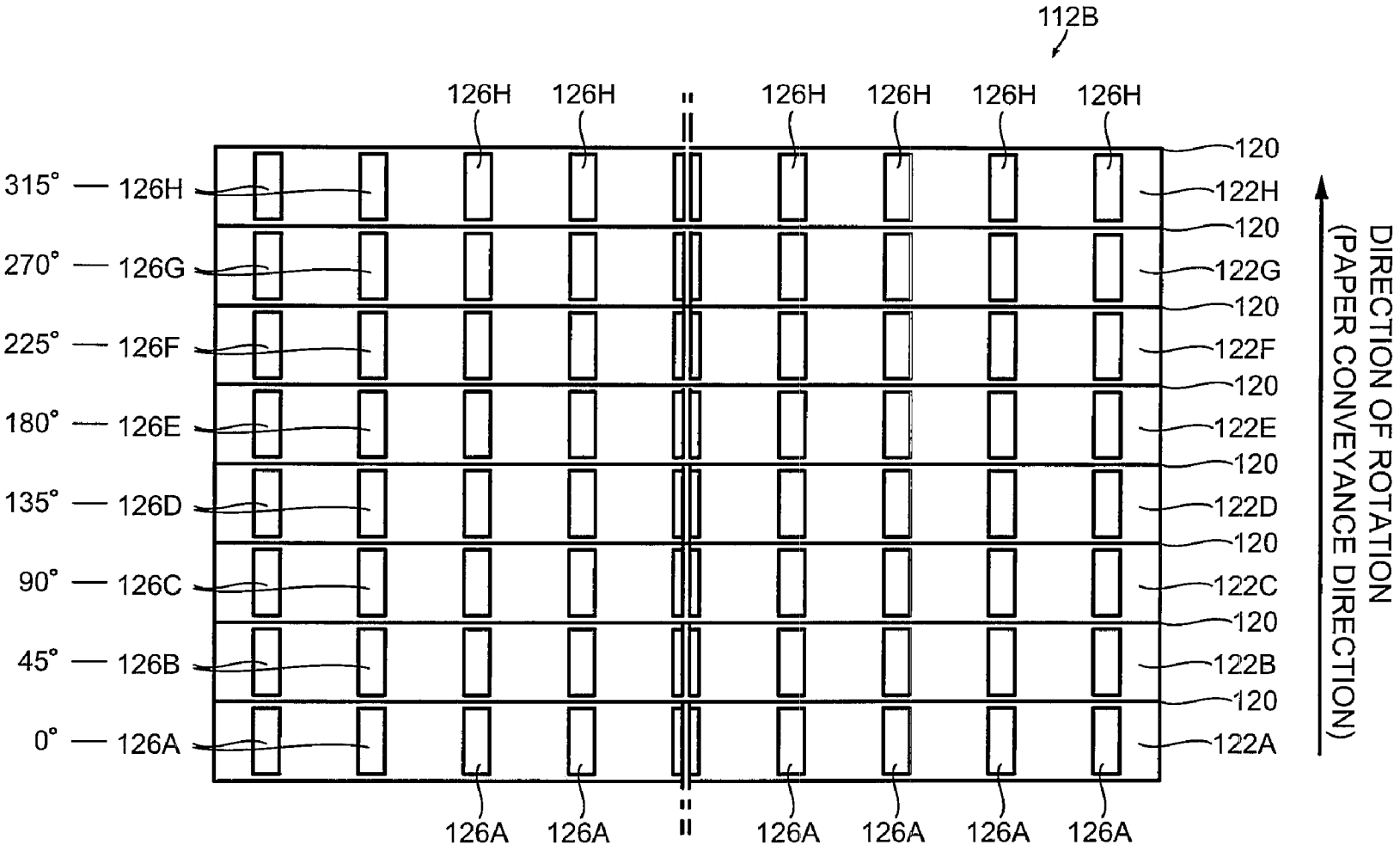
FIG. 4 is a projection view of the inner circumferential surface of an inner tube.

FIG. 4 is a projection view of the inner circumferential surface of the inner tube 112B. As illustrated in FIG. 4, slits 126A to 126H are formed (at intervals of 45 degrees in the circumferential direction) in the inner circumferential surface of the inner tube 112B, so as to correspond to the spaces 122A to 122H which are divided by the dividing partitions 120. These slits 126A to 126H are formed so as to be connected independently to the respective spaces 122A to 122H, and are formed in plural fashion at a uniform pitch in the axial direction.

The axle tube 114 which has been inserted into the inner tube 112B is formed in a round cylindrical shape, and is inserted in the inner circumferential section of the inner tube 112B in a sealed state by means of sealing members (not illustrated). One end of this axle tube 114 (the left-hand end in FIG. 2) is fixed to the bracket 116 on one side (the left-hand side in FIG. 2) via a supporting member 128. Consequently, the suction drum main body 112 rotates about the axle tube 114 when it is rotated.

Figure 5:
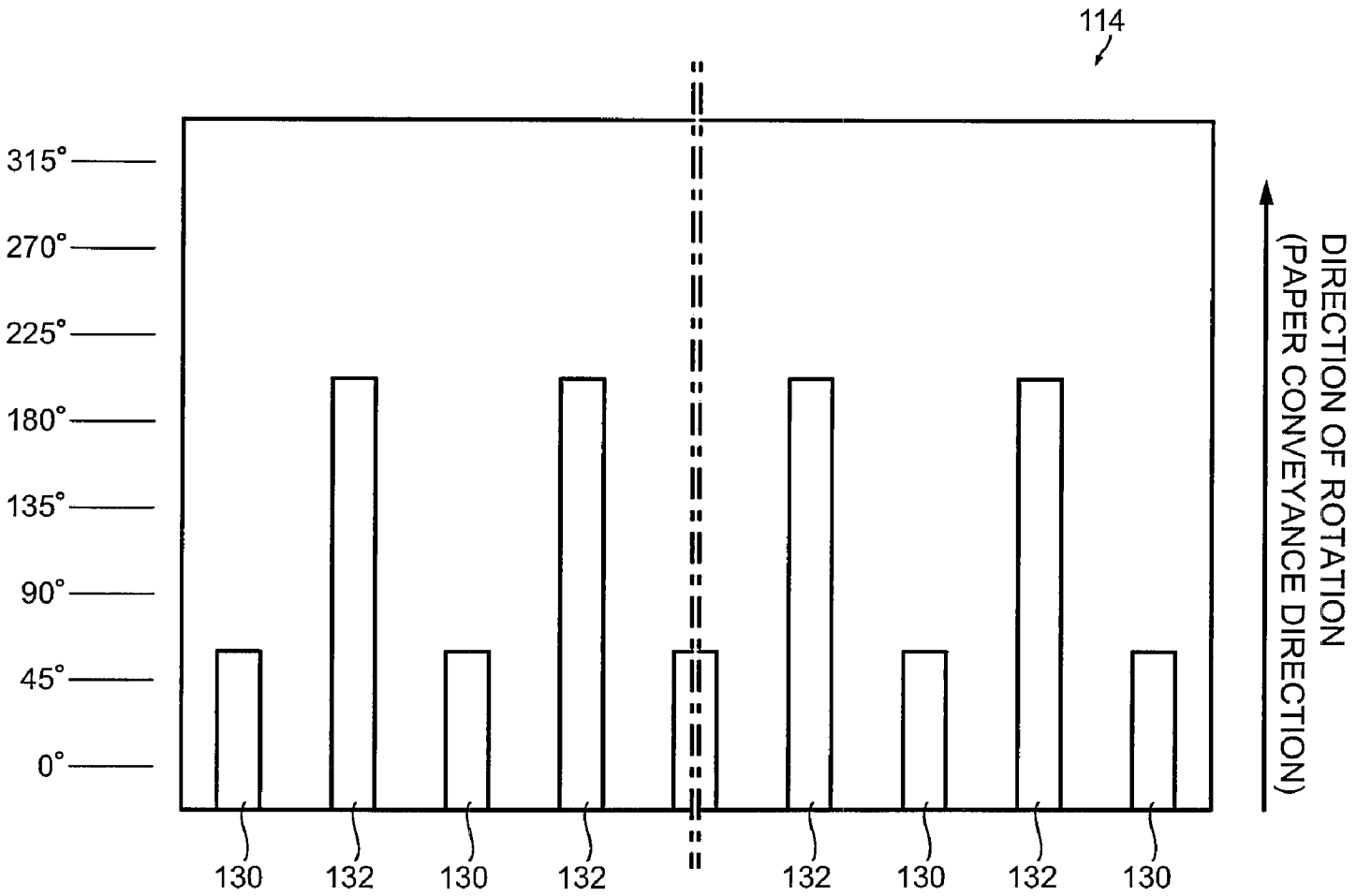
FIG. 5 is a projection view of the outer circumferential surface of an axle tube.

FIG. 5 is a projection view of the outer circumferential surface of the axle tube 114. As illustrated in FIG. 5, two slits 130 and 132 of different lengths are formed alternately at uniform pitch in the axial direction in the outer circumferential surface of the axle tube 114. The shorter slits 130 are formed from a position of about 0° to a position of about 80°, and the longer slits 132 are formed from a position of about 0° to a position of about 180°.

Figure 6:
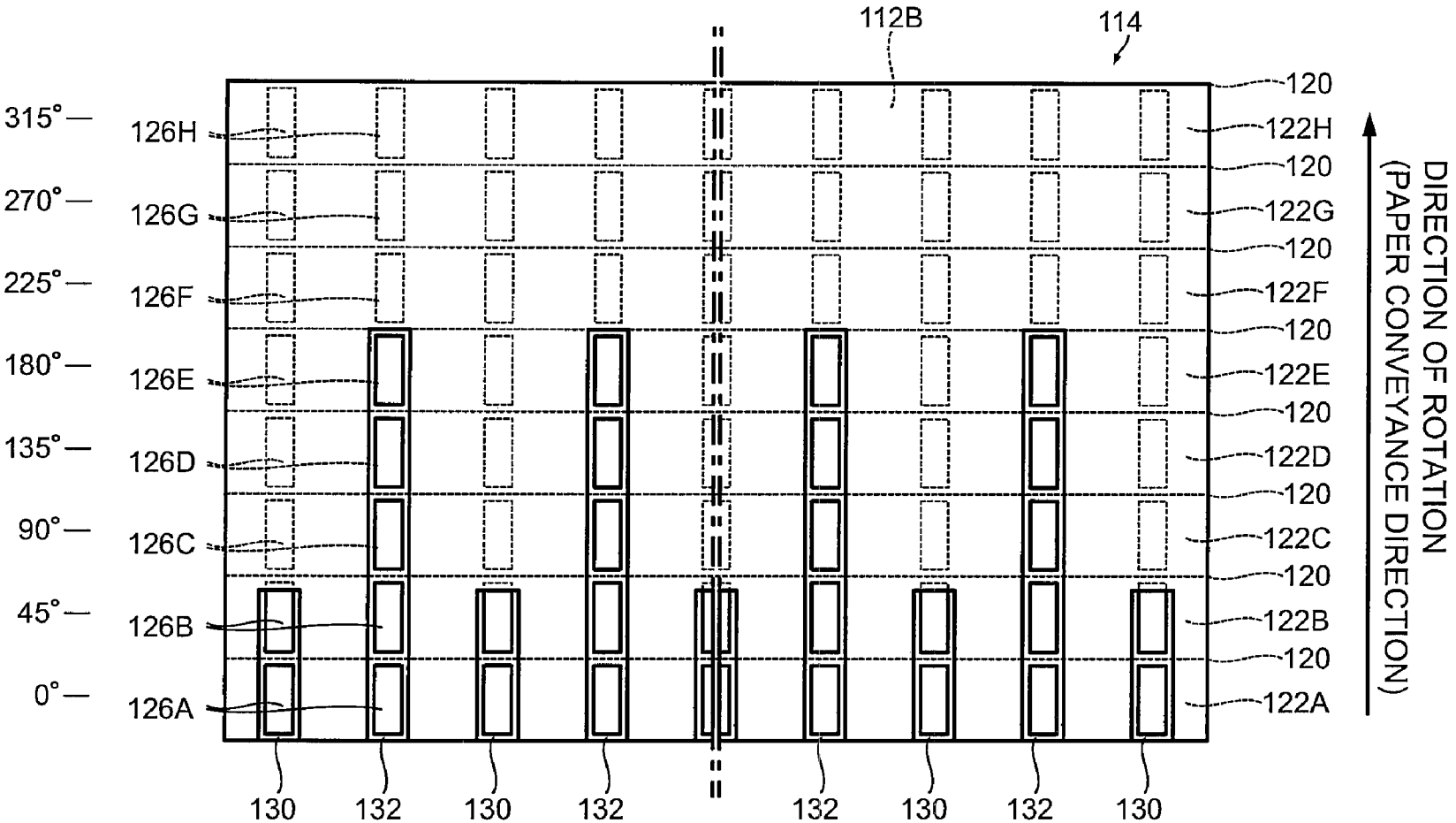
FIG. 6 is a projection view illustrating the relationship between slits formed in the outer circumferential surface of the axle tube and slits formed in the inner circumferential surface of the inner tube.

Here, as illustrated in FIG. 6, the interval in the axial direction at which the slits 130 and 132 are formed in the outer circumferential surface of the axle tube 114 is the same as the interval in the axial direction at which the slits 126A to 126H are formed in the inner circumferential surface of the inner tube 112B, and furthermore, their width is slightly greater than the width of the slits 126A to 126H formed in the inner circumferential surface of the inner tube 112B.

Therefore, when the axle tube 114 is inserted into the inner circumferential section of the inner tube 112B, the slits 130 and 132 are connected to the slits 126A to 126H which are formed so as to correspond to the spaces 122A to 122H of the inner tube 112B. The slits 126A to 126H in the inner tube 112B which are connected to the slits 130 and 132 in the axle tube 114 change in accordance with the rotational position of the suction drum main body 112. For example, looking in particular at the slit 126A formed so as to correspond to the space 122A, when the slit 126A is at the 0° position, then it connects with both the long and short slits 130 and 132, but when the slit 126A passes about 80°, the slit 126A is connected only with the longer slits 132, and when the slit 126A passes 180°, it becomes no longer connected to any slit (closed off).

The slits 126A to 126H of the inner tube 112B which are connected to the slits 130 and 132 of the axle tube 114 change and the amount of connection (the connected surface area: total surface area where slits are mutually overlapping) also changes, in accordance with the rotational position of the suction drum main body 112. In other words, the amount of connection is greatest at the 0° position, falls to one half when the position passes 80°, and becomes zero (closed off) when the position passes 180°. As a result, the suctioning force changes in accordance with the rotational position (namely, the suctioning force becomes weaker from the upstream side toward the downstream side in terms of the direction of rotation, and becomes progressively weaker as rotation advances.)

One end of the axle tube 114 (the right-hand end in FIG. 2) is formed so as to be closed off, and the other hand (the left-hand end in FIG. 2) is formed so as to be open. A suctioning fan 134 is installed on the other end which is formed in an open fashion, and the internal air is suctioned by means of this suctioning fan.

By suctioning the air inside the axle tube 114 by means of this suctioning fan 134, the air in the spaces 122A to 122H corresponding to the slits 126A to 126H which are connected to the slits 130 and 132 is suctioned, as a result of which air is suctioned from the suction holes 124 formed in the outer circumferential surface of the outer tube 112A and hence the recording paper 12 placed on the outer circumferential surface of the outer tube 112A is suctioned and held.

Gripping claws 138A and 138B are provided at two positions on the outer circumferential surface of the outer tube 112A, and the recording paper 12 is suctioned and conveyed while the leading end portion of the recording paper 12 is gripped by one of these gripping claws 138A and 138B. The two gripping claws 138A and 138B are disposed at opposing positions, and one gripping claw 138A is disposed between the internal spaces 122H and 122A of the suction drum main body 112. The other gripping claw 138B is disposed between the internal spaces 122D and 122E of the suction drum main body 112. Consequently, the suction drum main body 112 is able to suction and hold recording paper 12 on the outer circumferential surface corresponding to the internal spaces 122A to 122D, as well as suctioning and holding recording paper 12 on the outer circumferential surface corresponding to the internal spaces 122E to 122H as well. In other words, the suction drum main body 112 is formed so as to be able to convey two sheets of recording paper 12 in one revolution.

The composition of the gripping claws (grippers) of this kind is commonly known, and therefore description of the concrete composition thereof is omitted here.

The suction drum 110 having the composition described above grips the leading end of recording paper 12 supplied from a paper supply unit (not illustrated) by means of the gripping claw 138A or the gripping claw 138B, and suctions the air inside the axle tube 114 by means of the suctioning fan 134, thereby suctioning and holding the rear surface of the recording paper 12 via the suction holes 124 formed in the outer circumferential surface. By driving rotation by means of a rotational drive device (not illustrated), the recording paper 12 is conveyed while being suctioned. In this, the suctioning force which is acting on the recording paper 12 changes in accordance with the conveyance position of the recording paper 12 (the rotational position of the suction drum 110), and becomes weaker as conveyance progresses. In other words, the suctioning force acting on the recording paper 12 is greatest at the start of suctioning onto the suction drum 110 and becomes progressively weaker as the recording paper 12 is conveyed in the downstream direction (the suction drum 110 weakens the suctioning force acting from the surface where the recording paper 12 is suctioned). By this means, it is possible to convey the recording paper 12 stably, and to prevent the occurrence of wrinkling.

As illustrated in FIG. 1, at the suction start position of the recording paper 12 (in the present example, a position of approximately 0 degrees), a guide roller 160 is disposed so as to oppose the suction drum 110, and the recording paper 12 supplied from the paper supply unit is supplied between the guide roller 160 and the suction drum 110 and is suctioned and held on the outer circumferential surface of the suction drum 110.

The treatment liquid application unit 140 is constituted by: a treatment liquid tank 144 in which treatment liquid 142 is stored; a treatment liquid supply roller 146 which is disposed so as to be partially immersed in the treatment liquid 142 stored in the treatment liquid tank 144; an intermediate roller 148 disposed so as to abut against the outer circumferential surface of the treatment liquid supply roller 146; application rollers 150A to 150D, disposed between the intermediate roller 148 and the suction drum 110, which apply treatment liquid to the surface of the recording paper 12 suctioned and conveyed by the suction drum 110; and an application roller exchanging apparatus 152 which exchanges the application roller 150A to 150D being used.

The treatment liquid tank 144 is formed with an open upper side and treatment liquid 142 to be applied to the front surface of the recording paper 12 is stored therein.

The treatment liquid used in the present embodiment has an action of aggregating the coloring material contained in the ink that is deposited at a later stage by the color ink deposition unit 300 (in other words, it has properties of breaking down the dispersed state of the colorant, or the like, in the color inks, and thereby causing the colorant component, and the like, to aggregate and settle). More specifically, the treatment liquid is a liquid having the property of producing an aggregating reaction, such as a polyvalent metal salt reaction, an anionic/cationic reaction, a pH reaction, or the like, with the ink.

Actual examples of a treatment liquid of this type are commonly known, and therefore the actual composition of the treatment liquid is not described here. Furthermore, an optimal treatment liquid for use is selected appropriately in accordance with the type of ink deposited by the color ink deposition unit 300.

The treatment liquid supply roller 146 is provided in parallel with the suction drum 110 and is disposed above the treatment liquid tank 144. The lower portion of the roller is immersed in treatment liquid 142 stored in the treatment liquid tank 144. Therefore, treatment liquid is supplied to the outer circumferential surface of the treatment liquid supply roller 146 by means of rotation of the roller.

The intermediate roller 148 is provided in parallel with the treatment liquid supply roller 146, and is disposed in such a manner that the outer circumferential surface thereof abuts against the outer circumferential surface of the treatment liquid supply roller 146. A rotational drive device (for example, a motor) (not illustrated in figures) is coupled to this intermediate roller 148. The intermediate roller 148 rotates in the same direction as the suction drum 110 by being driven by this rotational drive device. By rotating this intermediate roller 148, the treatment liquid supply roller 146 abutted against the outer circumferential surface rotates and the treatment liquid deposited on the outer circumferential surface of the treatment liquid supply roller 146 is supplied (transferred) to the outer circumferential surface of the intermediate roller 148.

The treatment liquid that has been supplied to the intermediate roller 148 is supplied to the application roller 150A to 150D abutted against the outer circumferential surface of the intermediate roller 148 and is applied to the front surface of the recording paper 12 which is suctioned and conveyed by the suction drum 110. For the application rollers 150A to 150D, a plurality of rollers having different lateral widths are prepared so as to correspond to a plurality of paper sizes, and these rollers are provided so as to be exchangeable by means of the application roller exchanging apparatus 152.

Figure 7:
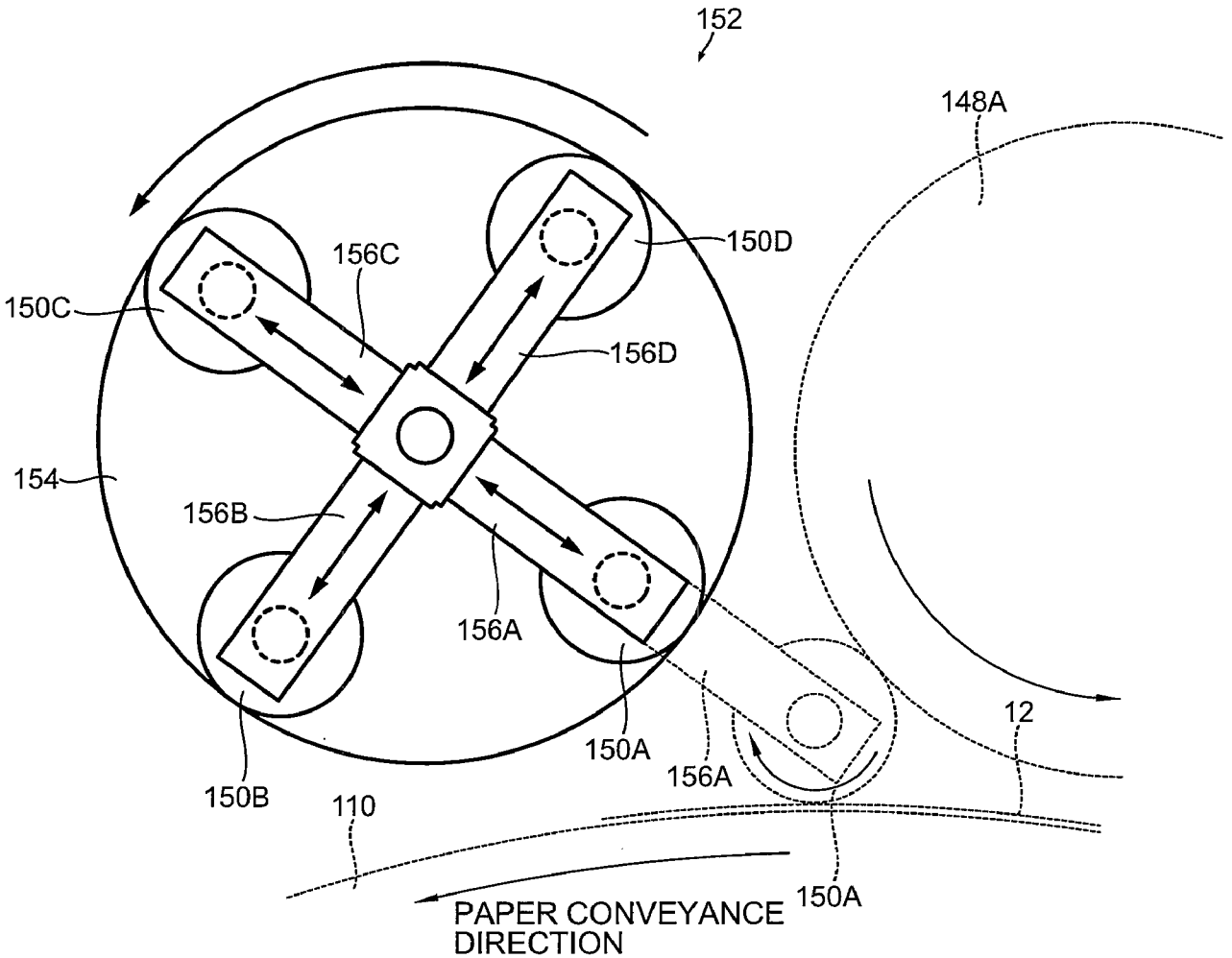
FIG. 7 is a side view illustrating the approximate composition of an application roller exchanging apparatus.

FIG. 7 is a side view illustrating the approximate composition of the application roller exchanging apparatus. The application roller exchanging apparatus 152 principally comprises a turret 154, and four extendable and retractable arms 156A and 156D provided in a radiating fashion on a shaft portion of this turret 154.

The turret 154 is provided in parallel with the suction drum 110 and is supported rotatably on a main body frame (not illustrated) of the image forming apparatus 10. This turret 154 is driven and rotated by a rotational drive device (not illustrated).

The arms 156A to 156D are installed in a radiating fashion on the shaft portion of the turret 154, and are driven by an extension and contraction drive device (for example, a cylinder) which is not illustrated, so as to extend and contract in the radial direction of the turret 154. The application rollers 150A to 150D are installed on the front end of the arms 156A to 156D, and either end portion of each roller is supported in a rotatable fashion on an axle bearing (not illustrated) which is provided on the arms 156A to 156D.

The exchanging of the application roller 150A to 150D by the application roller exchanging apparatus 152 composed as described above is performed as follows. Firstly, the turret 154 is rotated in a state where the arms 156A to 156D are contracted, and the application roller to be used is situated in a prescribed use position. The arm holding the application roller situated in this use position is extended, and the application roller is thereby set to a prescribed application position (in FIG. 7, the dotted line indicates a state where the application roller 150A is situated in the use position and the solid line indicates a state where the application roller 150A is situated in an application position.) Thereby, the exchange and setting of the application roller is completed.

When the application roller 150A to 150D to be used is disposed in the application position, the outer circumferential surface thereof abuts against the outer circumferential surface of the intermediate roller 148, as well as abutting against the outer circumferential surface (suctioning surface) of the suction drum 110. As a result of this, when the intermediate roller 148 rotates, the application roller also rotates and the treatment liquid supplied to the outer circumferential surface of the intermediate roller 148 is supplied to the outer circumferential surface of the application roller. The treatment liquid that has been supplied to the outer circumferential surface of the application roller is applied to the front surface of the recording paper 12 which is suctioned and conveyed by the suction drum 110. In other words, by passing the recording paper 12 between the suction drum 110 and the application roller, the treatment liquid is transferred and applied onto the front surface of the recording paper 12 from the application roller.

In the present embodiment, the application roller is abutted at approximately the 90° position of the suction drum 110, by being situated in the application position. Consequently, in the present embodiment, the treatment liquid is applied to the recording paper 12 at approximately the 90° position of the suction drum 110.

Furthermore, the selection of the application roller to be used is carried out automatically on the basis of the output of a paper width sensor (not illustrated), and an application roller which corresponds to the width of the recording paper 12 to which treatment liquid is to be applied is selected automatically. Here, the paper width sensor is a sensor which determines the width of the recording paper and is disposed in the paper supply unit, for instance.

The selection of the application roller to be used can also be performed manually by an operator.

Furthermore, in order to ensure a reliable aggregating reaction of the treatment liquid applied by the application roller, the treatment liquid is applied to a region that is narrower than the recording paper 12 and broader than the image forming region. Consequently, the application width of the treatment liquid achieved by the application roller is set to be narrower than the width of the recording paper 12, and greater than the width of the image forming region.

As described above, the treatment liquid deposition unit 100 is constituted by a suction drum 110 and an application unit 140, the recording paper 12 supplied from the paper supply unit is suctioned and conveyed on the suction drum 110, and the treatment liquid is applied to the front surface of the recording paper 12 by means of the application unit 140 during this conveyance. In other words, by means of the application roller making contact with the surface of the paper during conveyance, the treatment liquid that has been deposited onto the application roller is transferred to the front surface of the recording paper 12, and consequently, the treatment liquid is applied to the front surface of the recording paper 12.

As described above, the suction drum 110 suctions the recording paper 12 with the strongest suction force at the start of suctioning, and when the recording paper 12 is suctioned, the suctioning force becomes weaker successively from this suctioned area. By controlling the suctioning force in this way, it is possible to convey the recording paper 12 stably, and to prevent the occurrence of treatment liquid non-uniformities.

In other words, when the suctioning of the recording paper 12 starts, the ratio of the suction holes 124 closed off by the recording paper 12 is low and therefore it is difficult to apply a negative pressure and there is a possibility that stable suctioning will be impossible; however, by strengthening the suctioning force at the start of suctioning, it becomes possible to suction the recording paper 12 to the suction drum 110 in a stable fashion.

On the other hand, if treatment liquid is applied to the application unit 140 while still applying a strong suctioning force, the recording paper 12 becomes depressed (forming recess portions) in the portions corresponding to the suction holes 124, the treatment liquid becomes liable to collect in these recess portions, and hence there is a possibility that the amount of treatment liquid increases. Furthermore, the permeation of the treatment liquid into the recording paper 12 is only accelerated by the suctioning force in a certain perimeter position of the suction holes 124, and hence there is a possibility that non-uniformities occur in the density of treatment liquid. Moreover, if the treatment liquid is deposited by ejection, then there is also a problem in that deviations occur in the depositing positions due to the recess portions. Therefore, by weakening the suctioning force after suctioning the recording paper 12, the problems described above are eliminated and therefore the occurrence of non-uniformities in the treatment liquid can be prevented.

By applying treatment liquid while the recording paper 12 is suctioned and conveyed in this way, it is possible to reduce movement of the treatment liquid or non-uniformities in permeation. Since it is possible to reduce movement of the treatment liquid and non-uniformities in the permeation of the treatment liquid in this way, it is possible to decrease the occurrence of non-uniformities in the reaction with the ink, as well as being able to reduce image non-uniformities.

In the present embodiment, suctioning is started at approximately the 0° position, and the application of treatment liquid is carried out at approximately the 90° position, and therefore a composition is adopted whereby the suctioning force is made weaker from the start of suctioning at approximately the 0° position until reaching approximately the 90° position. If the suctioning of the recording paper is started and the application of treatment liquid is carried out at positions other than these, the suctioning is controlled in accordance with these positions. In this case also, a composition is adopted whereby the suctioning force is strongest at the start of suctioning, and becomes weaker until reaching the application position.

Furthermore, most desirably, the suction drum 110 is composed in such a manner that the suctioning force can be controlled in accordance with the conveyance position, as in the present embodiment, but it is also possible to adopt a composition in which the whole area is suctioned with a uniform suctioning force. Moreover, in controlling the suctioning force, the composition is not limited to that of the present embodiment, and it is also possible to control the suctioning force by means of another composition.

Furthermore, in the present embodiment, a composition is adopted in which the recording paper 12 is suctioned and conveyed by the suction drum 110, but the composition for suctioning and conveying the recording paper 12 is not limited to this and it is also possible to suction and convey the recording paper 12 by means of a different composition. For example, it is also possible to adopt a composition which suctions and conveys the recording paper by means of a conveyance belt having suction holes.

Moreover, in the present embodiment, treatment liquid is deposited onto the recording paper by bringing an application roller onto which treatment liquid has been deposited into contact with the front surface of the recording paper, but it is also possible to adopt a composition which applies treatment liquid to the surface of the recording paper by ejecting treatment liquid from a recording head, similarly to the color ink deposition unit 300 which is described below. In this case, it is also possible to adopt a composition which deposits treatment liquid onto the whole surface of the recording paper 12, and it is also possible to adopt a composition which deposits treatment liquid onto only the pixels where an image is formed, in relation to the image that is to be formed (the pixels (1 to 3 pixels) surrounding a pixel where an image is to be formed). Furthermore, if the treatment liquid is deposited so as to correspond to the image that is to be formed, then in order to avoid landing interference of the treatment liquid, desirably, the treatment liquid is ejected in a thinned out fashion in respect of the pixels where an image is to be formed, in such a manner that the droplets of treatment liquid do not make contact with each other but rather can be present in the form of independent droplets.

Moreover, in the present embodiment, the plurality of application rollers having different widths corresponding to the paper size of the recording paper 12 are exchangeable, but it is also possible to adopt a composition which uses exchangeable application rollers (for example, sponge rollers, or the like) having the same lateral width but different application volumes.

Treatment Liquid Drying Unit

The treatment liquid drying unit 200 is disposed to the downstream side of the treatment liquid deposition unit 100 and receives the recording paper 12 onto which treatment liquid has been deposited from the suction drum 110 of the treatment liquid deposition unit 100, and dries the treatment liquid that has been deposited onto the front surface of the recording paper 12.

Figure 8:
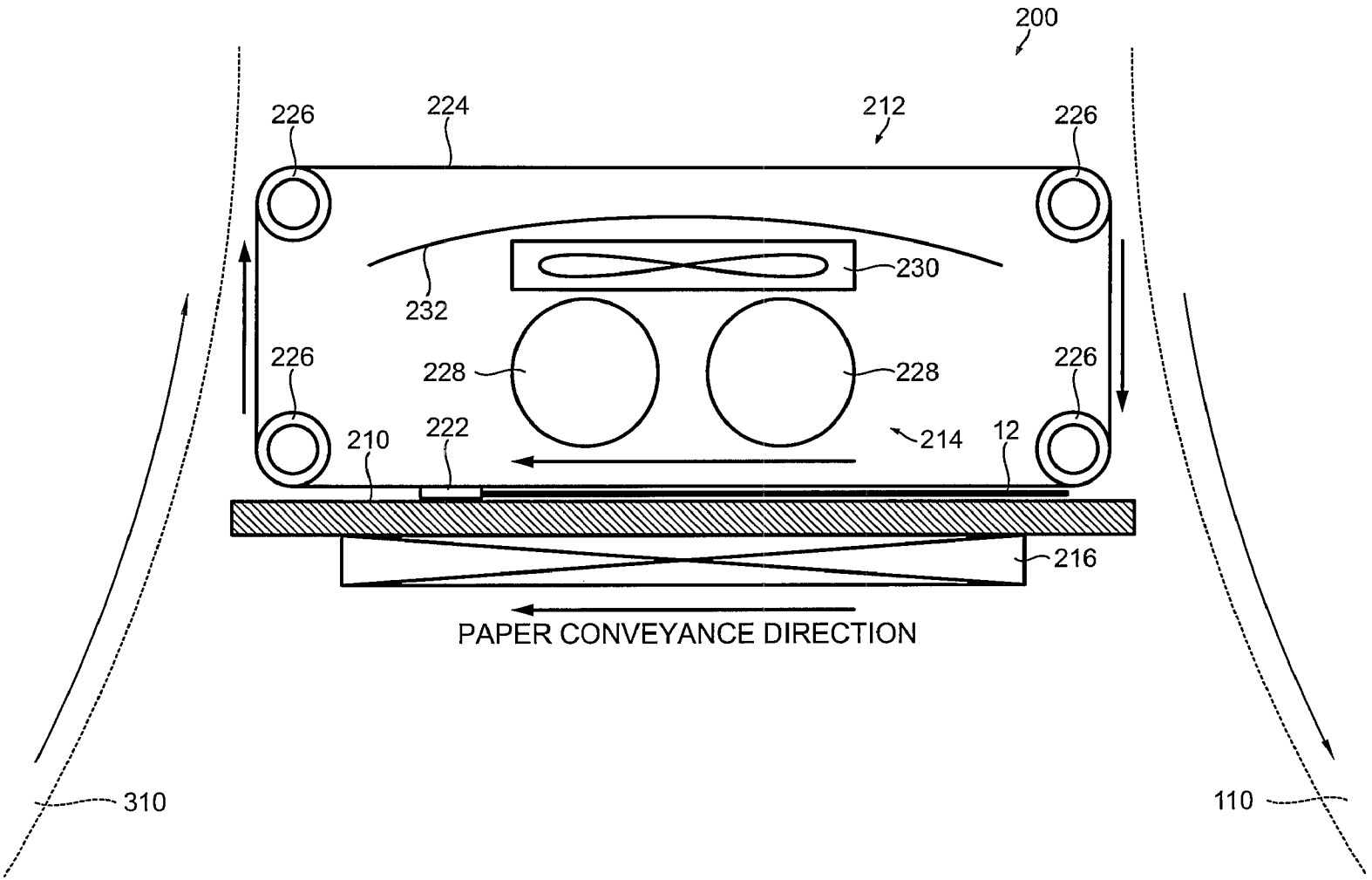
FIG. 8 is a general schematic drawing of a treatment liquid drying unit.

FIG. 8 is a schematic drawing of the treatment liquid drying unit 200. As illustrated in FIG. 8, the treatment liquid drying unit 200 comprises: a heating conveyance surface 210 over which the recording paper 12 is conveyed while sliding; a conveyance apparatus 212 which receives the recording paper 12 from the suction drum 110 and which conveys the recording paper by sliding over the heating conveyance surface 210; a fan heater unit 214 which blows a warm air flow onto the front surface of the recording paper 12 conveyed by sliding over the heating conveyance surface 210; and a heater 216 which heats the heating conveyance surface 210.

The heating conveyance surface 210 is constituted as a flat horizontal surface, and is formed with a width in the direction perpendicular to the conveyance direction that corresponds to the recording paper 12 having the greatest width. In other words, it is formed to be greater than the width of the recording paper 12 of maximum size, of the recording papers 12 which are handled by the image forming apparatus 10.

The heater 216 is installed on the rear surface of the heating conveyance surface 210 and thereby heats the heating conveyance surface 210 to a prescribed temperature. The recording paper 12 is conveyed by sliding over the heating conveyance surface 210 which is heated by the heater 216, thereby heating the paper from the rear surface.

As illustrated in FIG. 8, the conveyance apparatus 212 comprises a gripping claw 222 which travels along a prescribed path of travel, grips the leading end of the recording paper 12 by means of this gripping claw 222, and thereby conveys the recording paper 12.

The gripping claw 222 is installed on an endless belt 224. The belt 224 is wound about four guide rollers 226 and travels along a quadrilateral path of travel formed by these four guide rollers 226.

Here, the lower edge portion of the quadrilateral path of travel formed by these four guide rollers 226 is provided in parallel with and in the proximity of the heating conveyance surface 210. Therefore, when the belt 224 travels, the gripping claw 222 provided on the belt 224 travels following the heating conveyance surface 210, over the heating conveyance surface 210.

The belt 224 is caused to travel by driving one of the guide rollers 226 to rotate, and a rotational drive device, which is not illustrated (for example, a motor, or the like) is connected to one of the guide rollers 226.

Furthermore, the gripping claw 222 grips the leading end of the recording paper 12, but the composition of the gripping claw (gripper) which grips the leading end of the recording paper 12 in this way is commonly known and therefore the concrete composition of the gripping claw is not described here.

The fan heater unit 214 is disposed above the heating conveyance surface 210 (in the present embodiment, to the inner side of the belt 224 of the conveyance apparatus 212), and a heated air flow is blown onto the heating conveyance surface 210. This fan heater unit 214 principally comprises an infrared heater 228, a fan 230 and a reflector 232.

The infrared heater 228 is disposed perpendicularly to the direction of conveyance of the recording paper 12 and is formed to substantially the same width (length) as the width of the heating conveyance surface 210. It is also possible to adopt a composition in which a plurality of short infrared heaters are aligned in a direction perpendicular to the direction of conveyance of the recording paper 12.

The fan 230 is disposed above the infrared heater 228 and a plurality of fans are aligned independently following the infrared heater 228. The air heated by the infrared heater 228 is blown toward the heating conveyance surface 210 by the fans 230.

The reflector 232 is disposed above the fans 230 so as to surround the upper portion of the infrared heater 228.

The fan heater unit 214 composed as described above promotes the drying of the recording paper 12 conveyed over the heating conveyance surface 210 by blowing the air heated by the infrared heater 228 toward the heating conveyance surface 210 by means of the fans 230.

The air flow blown by the fan heater unit 214 in this way has the purpose of promoting the drying of the recording paper 12, and therefore the temperature of the infrared heater 228 is desirably set to an optimal value, as appropriate, within a range that achieves this purpose. For example, the temperature of the heated air flow blown toward the heating conveyance surface 210 is set to be 50° C. to 150° C.

As described above, the treatment liquid drying unit 200 comprises a heating conveyance surface 210, a conveyance apparatus 212, a fan heater unit 214 and a heater 216, and dries the treatment liquid applied to the front surface of the recording paper 12 by conveying the recording paper 12 by sliding over the heating conveyance surface 210 heated by the heater 216, while blowing a heated air flow by means of the fan heater unit 214. By this means, a layer of aggregating treatment agent in a solid state or semi-solid state is formed on the recording medium 12. Furthermore, by sliding and conveying the paper over the heating conveyance surface 210 which is heated in this fashion, it is possible to reduce drying non-uniformities caused by non-uniformity in the heating temperature. Moreover, drying is promoted by blowing the heated air flow.

Figure 9:
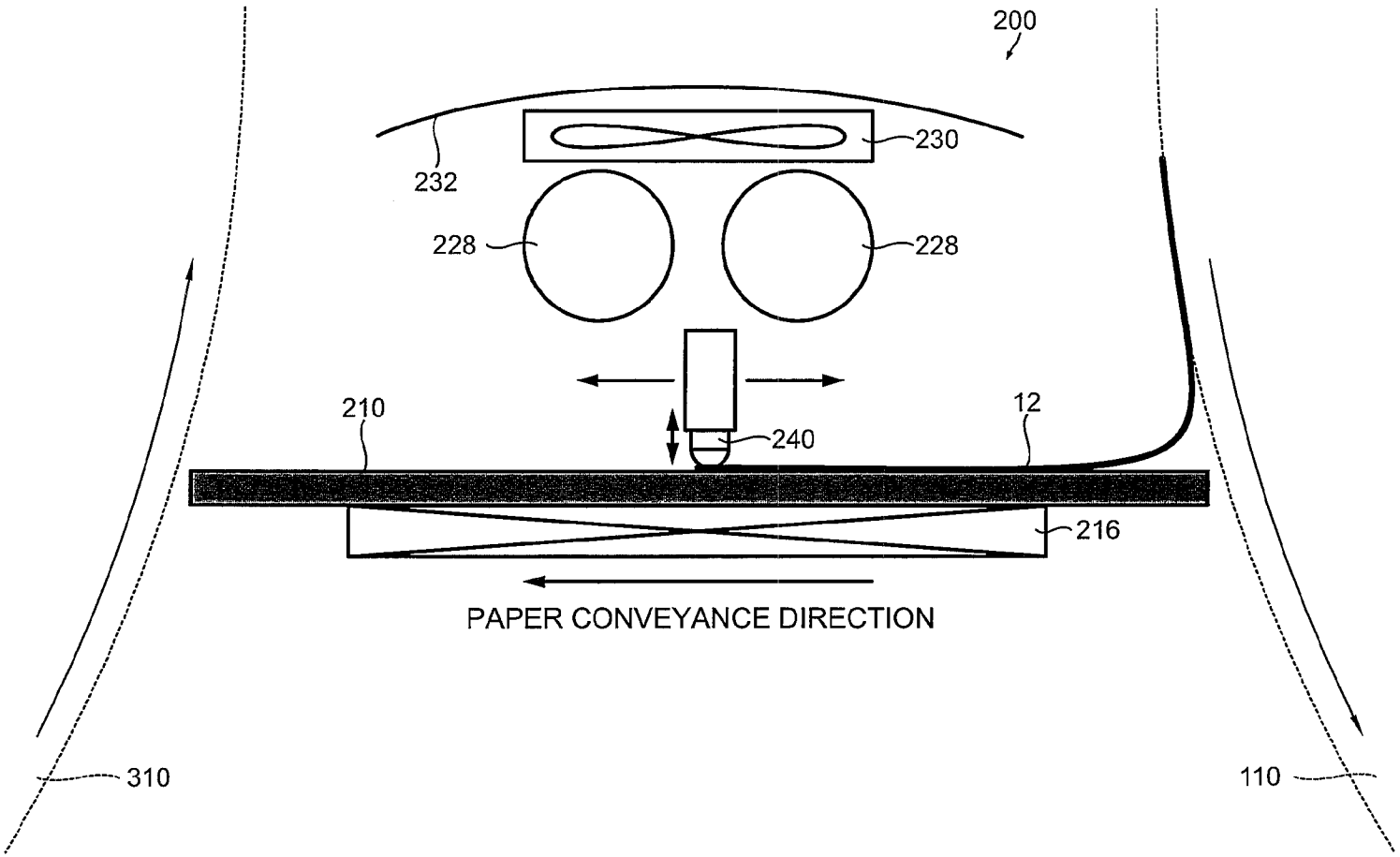
FIG. 9 is an approximate schematic drawing illustrating a further example of a treatment liquid drying unit.

In the present embodiment, the leading end of the recording paper 12 is gripped by the gripping claw 222, and by causing this gripping claw 222 to travel, the recording paper 12 is conveyed by sliding over the heating conveyance surface 210, but the device for conveying the recording paper 12 is not limited to this. However, if the treatment liquid which has been applied to the recording paper 12 is contacted before drying (complete or semi-solidification or increase in viscosity), then it becomes non-uniform, and therefore it is desirable to use a device which is able to convey the paper without making contact with the image forming region. For example, as illustrated in FIG. 9, a slider element 240 which is capable of advancing and retreating with respect to the heating conveyance surface 210 is provided so as to be movable reciprocally following the heating conveyance surface 210, and the recording paper 12 can be conveyed by sliding over the heating conveyance surface 210 by moving the slider element 240 over the heating conveyance surface 210 while pressing the leading end of the recording paper 12 against the heating conveyance surface 210 with the slider element 240 at a prescribed pressing force (a pressing force sufficient to enable the recording paper 12 to slide). In this case, desirably, the front end portion of the slider element 240 is formed from a material having large frictional resistance, such as rubber, in such a manner that it does not slip on the recording paper 12.

In the present embodiment, the recording paper 12 is conveyed by gripping the leading end, and the image forming region on the recording paper 12 is set as the region of the paper excluding this leading end gripping region.

Furthermore, in the present embodiment, the recording paper 12 is conveyed by a conveyance apparatus 212, but in cases where the recording paper 12 can be conveyed without using a conveyance apparatus 212, for instance, if the distance between the suction drum of the treatment liquid deposition unit 100 and the suction drum of the color ink deposition unit 300 described below is shorter than the length of the recording paper 12 (the length in the conveyance direction), then it is possible to omit the separate conveyance apparatus 212. In other words, a conveyance device of this type should only be provided in cases where the drying area must be made longer than the length of the recording paper 12, and does not have to be provided if the drying area is shorter then the length of the recording paper 12. However, even if the drying area is shorter than the length of the recording paper 12, by providing a conveyance device as in the present embodiment, it is possible to convey the recording paper 12 in a more stable state.

Figure 10:
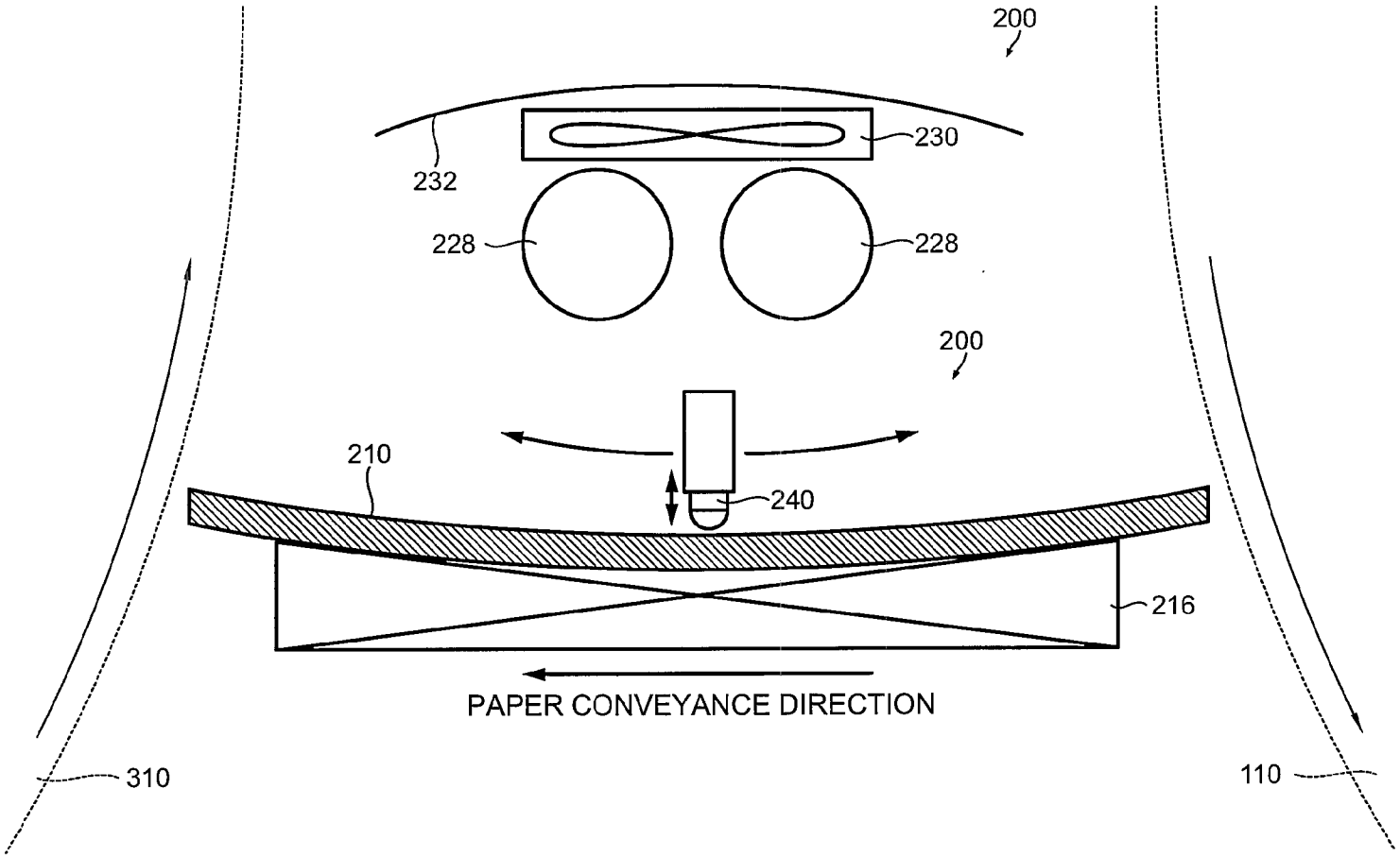
FIG. 10 is an approximate schematic drawing illustrating a further example of a treatment liquid drying unit.

Furthermore, in the present example, the heating conveyance surface 210 is formed as a horizontal flat surface, but it is also possible to form same as a curved surface as illustrated in FIG. 10. In particular, when treatment liquid has been applied to the recording paper 12, there is a possibility that the paper may curl, and therefore if a curved surface is adopted, it is possible to eliminate curl effectively by using a surface that is curved in a direction which suppresses this curl. Furthermore, by bending the heating conveyance surface 210 in a concave shape, it becomes easier to make the heated air flow strike the paper and the surface on which the treatment liquid has been deposited is dried as a concave shape, which is desirable since this is a direction which actively contracts the sides of the recording paper 12 that expand. In this case, desirably, the heated air flow is directed at the bottommost point of the concave shape.

Figure 11:
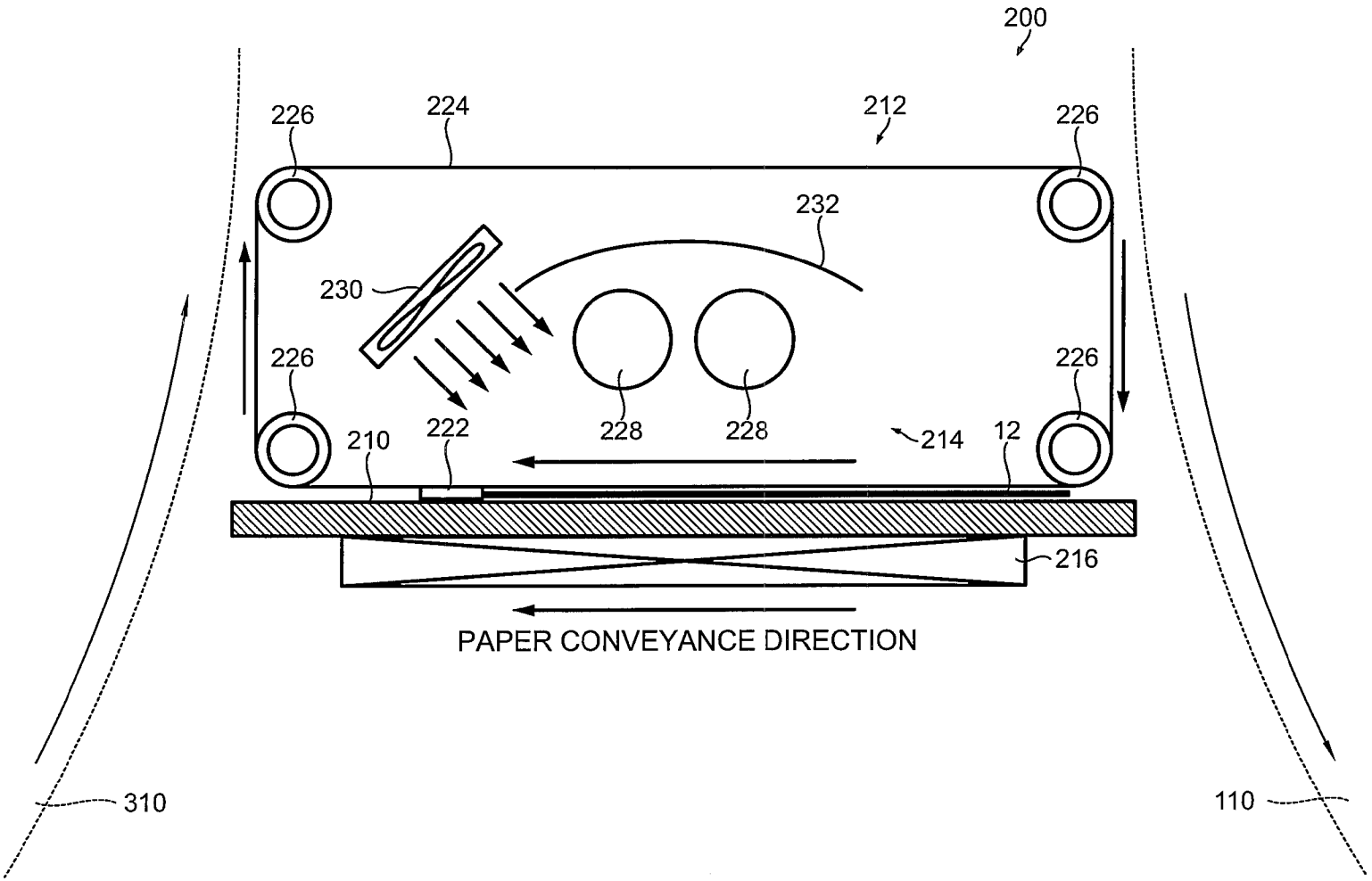
FIG. 11 is an approximate schematic drawing illustrating a further example of a treatment liquid drying unit.

In the present embodiment, a composition is adopted in which a heated air flow is blown vertically downwards by horizontally disposed fans 230 (the air is blown perpendicularly with respect to the recording paper 12), but by blowing the heated air flow obliquely from the downstream side toward the upstream side in terms of the direction of conveyance of the recording paper 12, as illustrated in FIG. 11, a composition which avoids trapping of the air flow is achieved and therefore drying can be promoted yet further.

Furthermore, in the present embodiment, a fan heater unit 214 is provided in order to promote drying, but it is also possible to adopt a composition for performing drying without providing a fan heater unit 214.

If a fan heater unit 214 is provided, as in the present embodiment, and the temperature of the heating conveyance surface 210 which makes contact with the recording paper 12 is controlled by controlling the fans 230 of the fan heater unit 214, as well as the heater 216 which heats the heating conveyance surface 210, then the controllability of the drying process is improved, and the load on the heater 216 which heats the heating conveyance surface 210 can be reduced.

Furthermore, if a fan heater unit 214 is provided and a heated air flow is blown as in the present embodiment, then by setting the width of the heating conveyance surface 210 to be greater than the width of the maximum-size recording paper 12, and by disposing discharge holes to the outside of the width of the maximum-size recording paper 12, it is also possible to discharge the heated air flow simultaneously. Therefore, it is possible to discharge the unwanted heated air flow smoothly, and hence no separate discharge fan, or the like, is required.

It is also possible to provide a fan heater unit of a similar type to or the same type as that of the present embodiment in the treatment liquid deposition unit 100 and to dry the treatment liquid by blowing a heated air flow onto the surface of the recording paper 12 onto which the treatment liquid has been applied, but in this case, the heated air flow strikes the application roller and there is a possibility that it will cause separation of the treatment agent (there is a possibility of nozzle blockages occurring in the case of a composition where the treatment liquid is deposited by a recording head). However, by adopting a composition in which the treatment liquid deposition unit 100 and the treatment liquid drying unit 200 are separated and the heat of the treatment liquid drying unit 200 is not transmitted to the treatment liquid deposition unit 100, it is possible to eliminate problems such as these.

Color Ink Deposition Unit

The color ink deposition unit 300 forms an image by depositing color inks onto the surface of the recording paper 12 on which the treatment liquid has been deposited. This color ink deposition unit 300 is constituted by a suction drum 310 which suctions and conveys the recording paper 12, and an ink ejection unit 350 which forms an image by ejecting color inks from a recording head onto the front surface of the recording paper 12 which is suctioned and conveyed by the suction drum 310.

Figure 12:
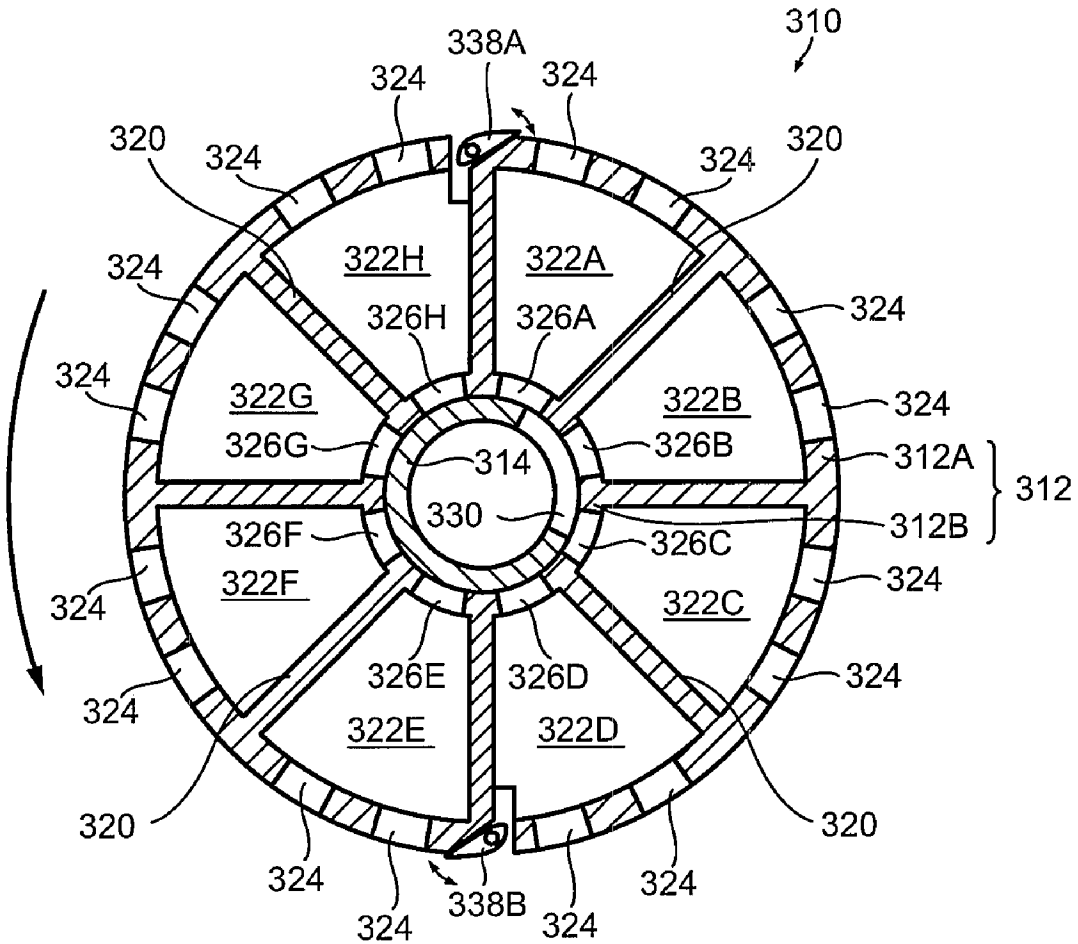
FIG. 12 is a side view cross-sectional diagram illustrating the approximate composition of a suction drum of a color ink deposition unit.

The composition of the suction drum 310 is substantially the same as the composition of the suction drum 110 of the treatment liquid deposition unit 100 which is described above. In other words, by suctioning air from the suction holes 324 formed in the outer circumferential surface (suctioning surface) as illustrated in FIG. 12, the suction drum 110 suctions and holds the rear surface of the recording paper 12 placed on the outer circumferential surface (suctioning surface) thereof by suctioning air via the suction holes formed on the outer circumferential surface, and the drum is rotated by driving a rotational drive device (for example, a motor), whereby the paper 12 suctioned and held on the outer circumferential surface is conveyed following a prescribed conveyance path (a circular arc-shaped conveyance path). Furthermore, this suctioning force is composed so as to be controllable, and by splitting the internal space into a plurality of areas, the suctioning force is composed so as to become weaker from the start of suctioning until the start of ink deposition.

However, the suction holes 324 are formed in a different mode to that of the suction drum 110 of the treatment liquid deposition unit 100.

In other words, the suction holes 124 formed in the outer circumferential surface of the suction drum 110 of the treatment liquid deposition unit 100, and the suction holes 324 formed in the outer circumferential surface of the suction drum 310 of the color ink deposition unit 300 are formed by adjusting their position, size, shape, and the like, in such a manner that they suction mutually different positions when suctioning the recording paper 12. In other words, the suction holes 124 of the treatment liquid deposition unit 100 and the suction holes 324 of the color ink deposition unit 300 are formed by adjusting their positions, size, shape, and the like, in such a manner that the positions where the suction holes 124 make contact with the recording paper 12 during the deposition of treatment liquid, and the positions where the suction holes 324 make contact with the recording paper 12 during the deposition of ink are mutually different.

By forming the respective suction holes in this way, it is possible to reduce image non-uniformities resulting from non-uniformities in the reaction of the treatment liquid. On the other hand, if both the treatment liquid and the ink are deposited onto the recording paper 12 while suctioning the paper from suction holes at the same positions, then the deposition non-uniformities of the treatment liquid and the deposition non-uniformities of the ink are superimposed on each other, and image non-uniformities become worse, but by staggering the positions where suction holes suction the recording paper during deposition of the treatment liquid with respect to the positions where suction holes suction the recording paper during deposition of the ink, it is possible to prevent mutual superimposition of the deposition non-uniformities of the treatment liquid and the deposition non-uniformities of the ink, and therefore image non-uniformities caused by non-uniformity in the reaction between the treatment liquid and the ink can be reduced.

Desirably, the positions where the suction holes suction the recording paper during the deposition of the treatment liquid and the positions where the suction holes suction the recording paper during the deposition of ink are staggered completely with respect to each other, but even if they are partially overlapping, it is possible to achieve similar beneficial effects by satisfying necessary conditions. This point is described in detail further below.

The suction drum 310 of the color ink deposition unit 300 receives the recording paper 12 at approximately the 0° position, in a similar fashion to the suction drum 110 of the treatment liquid deposition unit 100, but since the deposition of ink is started from a position of approximately 70°, then a composition is adopted whereby the suctioning force becomes weak by the time of reaching approximately the 70° position. In other words, the length of the slits formed in the outer circumferential surface of the axle tube is adjusted accordingly.

Furthermore, the suctioning force of the suction drum 310 of the color ink deposition unit 300 is set so as to be relatively higher than the suctioning force of the suction drum 110 of the treatment liquid deposition unit 100. Consequently, the recording paper 12 thus conveyed is prevented from making contact with the respective recording heads 360C, 360M, 360Y and 360K of the ink ejection unit 350, and therefore the incidence of jamming can be reduced.

Since the composition of the suction drum 310 is substantially the same as the composition of the suction drum 110 of the treatment liquid deposition unit 100 described above, further description of the concrete description thereof is omitted here.

In FIG. 12, reference numeral 312 indicates the suction drum main body, reference numeral 312A indicates an outer tube constituting the suction drum main body 312, reference numeral 312B indicates an inner tube constituting the suction drum main body 312, reference numeral 314 indicates an axle tube, reference numeral 320 indicates a partitioning wall which divides the internal space of the suction drum main body 312, reference numerals 322A to 322H indicate respective spaces which are divided by partitioning walls 320, reference numeral 324 indicate suction holes which are formed in the outer circumferential surface of the outer tube 312A (the outer circumferential surface of the suction drum main body 312 (suction surface)), reference numerals 326A to 326B indicate slits which connect to the respective spaces 322A to 322H that are formed on the circumferential surface of the inner tube 312B; reference numeral 330 indicates a slit formed in the axle tube 314 (short slit); and reference numerals 338A and 338B indicate gripping claws which grip the leading end of the recording paper 12. Apart from this, although not illustrated in the drawings, the fact that the inner tube 312B is supported rotatably on brackets via bearings and is driven to rotate by a rotational drive device (for example, a motor, or the like), the fact that the air inside the axle tube 314 is suctioned by the fan, and the like, are the same as the suction drum 110 of the treatment liquid deposition unit 100 which is described above.

The ink ejection unit 350 forms a color image on the front surface of the recording paper 12 by ejecting ink droplets of the four colors of cyan (C), magenta (M), yellow (Y) and black (K) toward the surface of recording paper 12 which is suctioned and conveyed by the suction drum 310.

Firstly, the general composition of the ink ejection unit 350 is described.

Ink droplets of the respective colors are ejected independently from the respectively corresponding recording heads 360C, 360M, 360Y and 360K. In other words, cyan ink droplets are ejected from the cyan recording head 360C, magenta ink droplets are ejected from the magenta recording head 360M, yellow ink droplets are ejected from the yellow recording head 360Y, and black ink droplets are ejected from the black recording head 360K, respectively and independently.

The recording heads 360C, 360M, 360Y and 360K which eject ink droplets of the respective colors independently are composed respectively by full line type recording heads, and form an image on the front surface of the recording paper 12 by ejecting ink droplets from a nozzle row (a row of nozzles which eject ink droplets (ink ejection ports)) formed in an ink ejection surface (the surface which ejects ink). This nozzle row is formed to a width corresponding to the maximum size of recording paper that is handled by the image forming apparatus 10. In other words, the nozzles are formed to a length which is able to cover at least the full width of the image forming region set on the maximum-size recording paper.

Furthermore, the recording heads 360C, 360M, 360Y and 360K are arranged in such a manner that the respective nozzle rows lie perpendicular to the direction of conveyance of the recording paper 12 (the sub-scanning direction) (an arrangement parallel to the direction that is perpendicular to the direction of conveyance of the recording paper 12 (the main scanning direction)), and the ink ejection surfaces thereof are disposed so as to maintain a prescribed clearance with respect to the outer circumferential surface of the suction drum 310.

Furthermore, the recording heads 360C, 360M, 360Y and 360K are disposed in a prescribed color sequence at a prescribed interval apart, from the upstream side in terms of the direction of conveyance of the recording paper 12. In the present embodiment, the recording heads 360C, 360M, 360Y and 360K are disposed about the circumferential surface of the suction drum 310 in the order, cyan (C), magenta (M), yellow (Y) and black (K), from the upstream side in terms of the direction of conveyance of the recording paper 12.

The recording heads of the respective colors can also be composed by so-called serial type (shuttle type) recording heads (recording heads of a type which move back and forth reciprocally in the main scanning direction), but higher speed printing becomes possible if the recording heads of the respective colors are constituted by full line type recording heads, as in the present embodiment.

Furthermore, in the present embodiment, an image is formed by inks of four colors of C, M, Y and K, but the number and combination of the colors of inks used are not limited to these. It is also possible to use light inks, dark inks, special color inks, or the like, in a complementary fashion, according to requirements. For example, it is possible to adopt a composition which additionally comprises recording heads for ejecting light inks, such as light cyan, light magenta, and the like. Furthermore, there are no particular restrictions of the sequence in which the recording heads of respective colors are arranged.

For the ink liquid, a liquid containing pigment as a coloring material, a resin polymer, a dispersant and a surfactant, and the like, is used.

Next, the structure of the recording heads 360C, 360M, 360Y and 360K is described in detail. Since the recording heads 360C, 360M, 360Y and 360K have a common structure, then the recording heads are represented below by the reference numeral 360.

Figure 13:
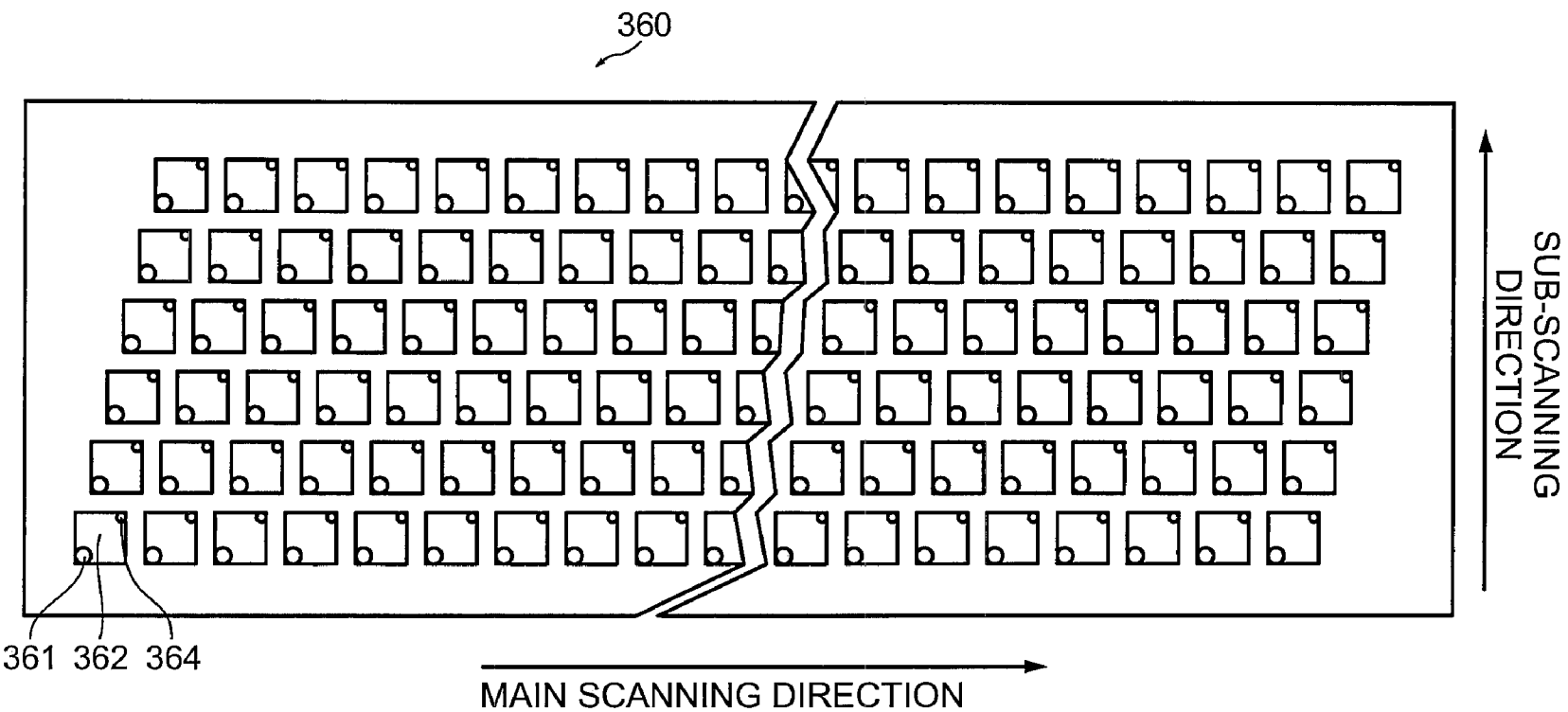
FIG. 13 is a plan view perspective diagram illustrating the approximate structure of a recording head.
Figure 14:
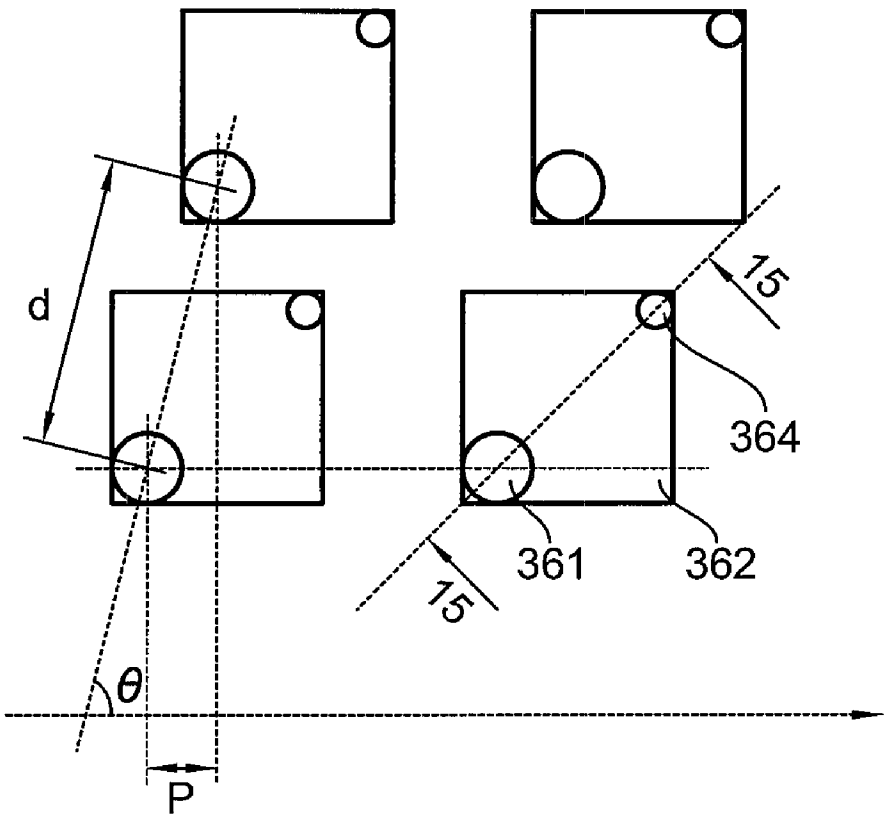
FIG. 14 is an enlarged diagram illustrating an enlarged view of a portion of FIG. 13.
Figure 15:
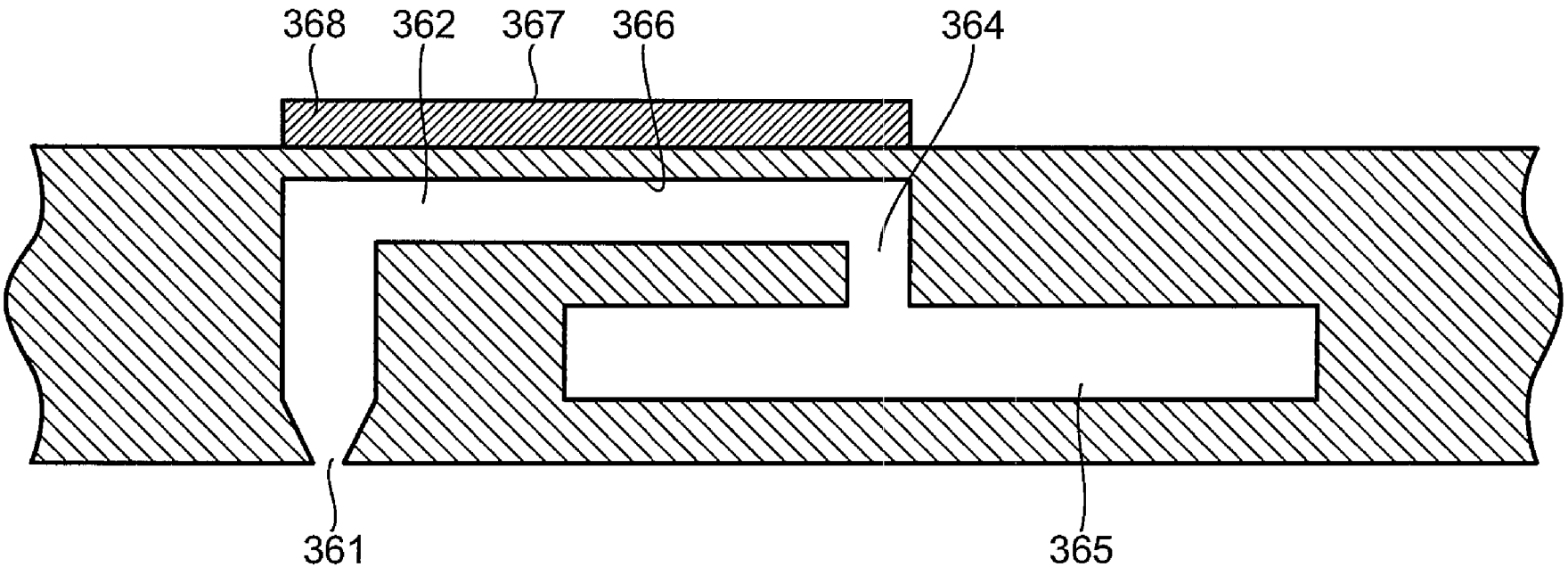
FIG. 15 is a cross-sectional diagram along line 15-15 in FIG. 14.

FIG. 13 is a plan view perspective diagram illustrating the approximate structure of the recording head 360, FIG. 14 is an enlarged diagram illustrating an enlargement of a portion of FIG. 13, and FIG. 15 is a cross-sectional diagram along line 15-15 in FIG. 14.

In order to achieve a high density of the dot pitch formed on the recording paper 12, it is necessary to achieve a high density of the interval between the nozzles (nozzle pitch) which are arranged on the ink ejection surface of the recording head 360.

In the recording head 360 according to the present embodiment, in order to achieve a high density of the nozzle pitch, the nozzles 361 are disposed in a staggered matrix fashion in the ink ejection surface, as illustrated in FIG. 13. By disposing the nozzles 361 in a staggered matrix arrangement, it is possible to achieve a high density of the effective nozzle pitch (projected nozzle pitch) of the nozzles projected to an alignment in the lengthwise direction of the head (the direction perpendicular to the direction of conveyance of the recording paper 12 (main scanning direction)).

More specifically, as illustrated in FIG. 13, by adopting the structure in which the plurality of ink chamber nozzles 361 are arranged at the uniform pitch d in line with the direction forming the angle of θ with respect to the main scanning direction, the pitch P of the nozzles 361 projected so as to align in the main scanning direction is $d \times \cos\theta$, and hence the nozzles 361 can be regarded to be equivalent to those arranged linearly at the fixed pitch P along the main scanning direction. Such configuration results in the nozzle structure in which the nozzle row projected in the main scanning direction has a high nozzle density of up to 2,400 nozzles per inch.

As illustrated in FIG. 13, the pressure chambers 362 are provided independently for each nozzle 361, and by arranging the pressure chambers 362 in a staggered (two-dimensional) matrix configuration, the nozzles 361 are arranged in a staggered arrangement on the ink ejection surface.

The pressure chambers 362 are formed to have a substantially square planar shape, and a nozzle 361 and an ink supply port 364 are provided in respective corner sections on a diagonal of this planar shape. As illustrated in FIG. 15, the ink supply ports 364 are connected to the common flow channel 365.

The common flow channel 365 is connected to an ink supply tank (not illustrated), and ink is supplied from this ink supply tank to the common flow channel 365. The ink supplied to this common flow channel 365 is distributed and supplied to the respective pressure chambers 362 via the ink supply ports 364 of the respective pressure chambers 362.

As illustrated in FIG. 15, the ceiling face of the pressure chambers 362 is constituted by a diaphragm 366 which also serves as a common electrode. A piezoelectric element 368 provided with an individual electrode 367 is bonded on top of the diaphragm 366 so as to correspond to each of the respective pressure chambers 362. The piezoelectric elements 368 are respectively deformed by applying a drive voltage to the individual electrodes 367, and the diaphragm 366 is deformed accordingly. By means of this deformation of the diaphragm 366, the volume inside the pressure chamber 362 is altered (compressed), and hence an ink droplet is ejected from the nozzle 361. Moreover, when the diaphragm 366 returns to its original shape, ink corresponding to the ink ejected from the nozzle 361 is supplied to the pressure chamber 362 from the common flow channel 365 via the ink supply port 364.

In the present embodiment, a composition is adopted in which ink droplets are ejected from the nozzles 361 using piezoelectric elements, but it is also possible adopt a composition (a so-called thermal method) in which a heater is provided inside each pressure chamber 362 and ink is ejected from a corresponding nozzle 361 by using the pressure of film boiling produced by heating by the heater.

Furthermore, in the present embodiment, in order to achieve a high density of the effective nozzle pitch, the nozzles are disposed in a staggered matrix configuration, but the arrangement structure of the nozzles is not limited in particular to this and it is possible to use various arrangement structures. For example, it is also possible to adopt a structure where the nozzles are arranged in one row in the sub-scanning direction.

Figure 16:
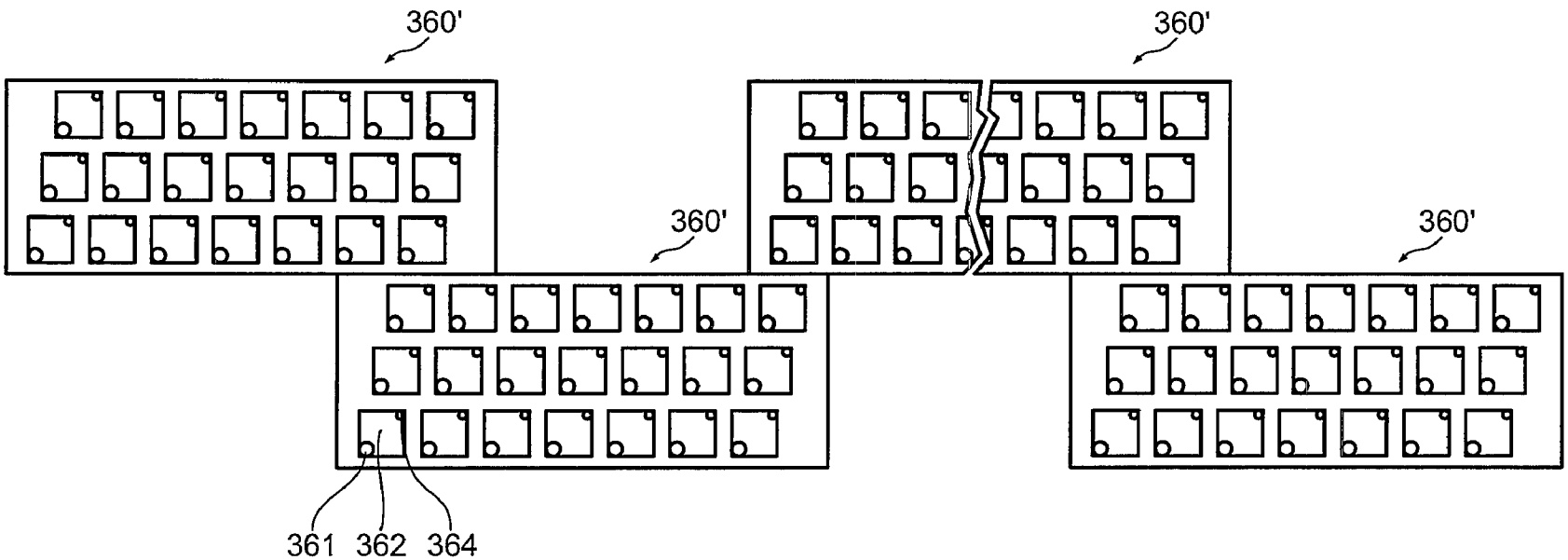
FIG. 16 is a plan view perspective diagram illustrating the approximate structure of a further example of a recording head.

Furthermore, in the present embodiment, a full line type of recording head having a nozzle row of a length corresponding to the full width of the recording paper 12 is composed by disposing nozzles in a staggered matrix configuration in one head block which is formed to a long dimension, but as illustrated in FIG. 16, it is also possible to constitute a full line type of recording head having a nozzle row of a length corresponding to the full width of the recording paper 12, by arranging and joining together in a staggered configuration, short head blocks 360' each having nozzles 361 arranged in a staggered configuration. Furthermore, although not illustrated in the drawings, it is also possible to compose a line head by arranging short heads with the nozzles in one row.

As described above, the color ink deposition unit 300 is constituted by a suction drum 310 and an ink ejection unit 350, and forms an image on the front surface of the recording paper 12 by ejecting color inks from the ink ejection unit 350 onto the front surface of the recording paper 12 which is suctioned and conveyed by the suction drum 310.

In this, the suction drum 310 grips the leading end of the recording paper 12 by the gripping claw of the suction drum 310, in the treatment liquid drying unit 200, and the recording paper 12 is suctioned and conveyed following a conveyance path formed in a circular arc shape by rotating the suction drum 310 while suctioning the rear surface of the paper by the suction holes 324 formed in the suction drum 310.

The recording paper 12 passes through the ink ejection unit 350 during the course of this conveyance, and when the paper passes the ink ejection unit 350, ink droplets are ejected from the recording heads 360C, 360M, 360Y and 360K of the ink ejection unit 350, thereby forming an image on the surface of the paper.

Since treatment liquid has been applied previously onto the front surface of the recording paper 12 (and more specifically, since the treatment liquid has been dried and therefore a layer of aggregating treatment agent in a solid or semi-solid state (a thin layer of dried treatment liquid) has been formed), then when the ink droplets land on the front surface of the recording paper 12, the coloring material in the ink droplets thus deposited is aggregated due to the action of the treatment liquid. Consequently, it is possible effectively to prevent the occurrence of bleeding, and the like. In other words, when an ink droplet lands on the layer of aggregating treatment agent, the ink droplet lands with a prescribed contact surface area on the layer of aggregating treatment agent, based on a balance between the kinetic energy of the droplet and the surface energy. An aggregating reaction starts immediately after the ink droplet has landed on the aggregating treatment agent, but this reaction starts from the contact surface between the ink droplet and the aggregating treatment agent layer. Since the aggregating reaction occurs only in the vicinity of the contact surface, and the coloring material in the ink aggregates while receiving an adhesive force and maintaining the contact surface area upon landing of the ink, then movement of the coloring material is suppressed. Therefore, even if another ink droplet is deposited adjacently to this ink droplet, since the coloring material of the previously deposited ink will already have aggregated, then the coloring material does not mix with that of the subsequently deposited ink, and therefore bleeding is suppressed.

Furthermore, as described above, the suctioning force of the suction drum 310 is controlled in the conveyance direction in such a manner that the recording paper 12 receives the strongest suctioning force at the start of suction and the suctioning force becomes weaker by the start of the ejection of ink droplets. Accordingly, it is possible to prevent the occurrence of wrinkling, and to convey the recording paper 12 in a stable fashion, as well as being able to prevent the occurrence of deviation in the depositing positions due to depression of the recording paper 12 at the positions of the suction holes 324.

Furthermore, similarly to the suction drum 110 of the treatment liquid deposition unit 100, most desirably, the suction drum 310 is composed in such a manner that the suctioning force can be controlled in accordance with the conveyance position, but it is also possible to adopt a composition in which the whole area is suctioned with a uniform suctioning force. Moreover, in controlling the suctioning force, the composition is not limited to that of the present embodiment, and it is also possible to control the suctioning force by means of another composition.

Furthermore, in the present embodiment, a composition is adopted in which the recording paper 12 is suctioned and conveyed by the suction drum 310, but the composition for suctioning and conveying the recording paper 12 is not limited to this and it is also possible to suction and convey the recording paper 12 by means of a different composition. For example, it is also possible to adopt a composition which suctions and conveys the recording paper by means of a conveyance belt having suction holes.

Solvent Drying Unit

The solvent drying unit 400 dries the ink solvent which remains on the front surface of the recording paper 12 on which the color inks have been deposited.

When ink droplets are ejected onto the recording paper 12 to which treatment liquid has been applied, as described above, the coloring material in the ink aggregates due to the action of the treatment liquid, and an ink aggregate (coloring material aggregate) is formed on the recording paper 12. On the other hand, the ink solvent which has separated from the coloring material spreads on the recording paper 12, and a liquid layer in which the aggregating treatment agent is dissolved is formed. The solvent component (liquid component) of the ink left on the recording paper 12 in this way is a cause of curling of the recording paper 12 and also leads to deterioration of the image. Therefore, in the solvent drying unit 400, the solvent component is removed from the recording paper 12 onto which the color inks have been deposited by the color ink deposition unit 300.

This solvent drying unit 400 has the same composition as the treatment liquid drying unit 200 described above and by conveying the recording paper by sliding over the heating conveyance surface 210 which is heated, as well as blowing a heated air flow from above, the solvent component remaining on the front surface of the recording paper 12 is dried (evaporated) and removed.

In this way, the solvent drying unit 400 has the same composition as the treatment liquid drying unit 200, and therefore description of the concrete composition thereof is omitted here.

In FIG. 1, reference numeral 410 indicates a heating conveyance surface, reference numeral 412 indicates a conveyance apparatus which receives recording paper 12 from the suction drum 310 of the color ink deposition unit 300 and conveys the recording paper by sliding over the heating conveyance surface 410, reference numeral 414 indicates a fan heater unit which blows a heated air flow onto the recording paper 12 conveyed over the heating conveyance surface 410, reference numeral 416 is a heater which heats the heating conveyance surface 410, and reference numeral 422 is a gripping claw of the conveyance apparatus 412.

The solvent drying unit 400 conveys the recording paper 12 along a prescribed conveyance path by receiving the recording paper 12 from the suction drum 310 of the color ink deposition unit 300 and gripping the leading end of the recording paper 12 by the gripping claw 422 of the conveyance apparatus 412, and causing the gripping claw 422 to travel. During the course of this conveyance, the recording paper 12 is heated from the rear surface by the heating conveyance surface 410, and furthermore a heated air flow is blown from the fan heater unit 214 onto the front surface of the paper. By this means, the solvent component remaining on the front surface of the recording paper 12 is dried and removed.

Similarly to the treatment liquid drying unit 200, the device which conveys the recording paper 12 is not limited to that described above and it is also possible to employ a composition which conveys the recording paper 12 by means of the conveyance apparatus illustrated in FIG. 9.

Furthermore, in cases where it is possible to convey the recording paper 12 without using a conveyance apparatus 412, then the separate conveyance apparatus 412 does not have to be provided.

Moreover, similarly to the heating conveyance surface 210 of the treatment liquid drying unit 200, the heating conveyance surface 410 can also be formed as a curved surface. In particular, when ink has been deposited on the recording paper 12, there is a possibility that the paper may curl, and therefore if a curved surface is adopted, it is possible to eliminate curl effectively by using a surface that is curved in a direction which suppresses this curl. Furthermore, by bending the heating conveyance surface 410 in a concave shape, it becomes easier to make the heated air flow strike the paper and the surface on which the treatment liquid has been deposited is dried as a concave shape, which is desirable since this is a direction which actively contracts the sides of the recording paper 12 that expand. In this case, desirably, the heated air flow is directed at the bottommost point of the concave shape.

Furthermore, if the heated air flow is blown obliquely from the downstream side toward the upstream side in terms of the direction of conveyance of the recording paper 12, then a composition which avoids trapping of the air flow is achieved and drying can be promoted yet further (see FIG. 10).

Furthermore, in the present embodiment, a fan heater unit 414 is provided in order to promote drying, but it is also possible to adopt a composition for performing drying without providing a fan heater unit 414.

If a fan heater unit 414 is provided, and the temperature of the heating conveyance surface 410 which makes contact with the recording paper 12 is controlled by controlling the fans of the fan heater unit 414, as well as the heater 416 which heats the heating conveyance surface 410, then the controllability of the drying process is improved, and the load on the heater 416 which heats the heating conveyance surface 410 can be reduced.

Furthermore, if a fan heater unit 414 is provided and a heated air flow is blown as in the present embodiment, then by setting the width of the heating conveyance surface 410 to be greater than the width of the maximum-size recording paper 12, and by disposing discharge holes to the outside of the width of the maximum-size recording paper 12, it is also possible to discharge the heated air flow simultaneously. Therefore, it is possible to discharge the unwanted heated air flow smoothly, and hence no separate discharge fan, or the like, is required.

It is also possible to dry the residual solvent by providing a fan heater unit of the same type as the present embodiment in the color ink deposition unit 300, and blowing a heated air flow onto the front surface of the recording paper 12 to which color inks have been applied, but in this case, there is a possibility that the blown heated air flow will strike the recording heads 360C, 360M, 360Y and 360K and give rise to nozzle blockages. However, by adopting a composition in which the color ink deposition unit 300 and the solvent drying unit 400 are separated as in the present embodiment, and the heat of the solvent drying unit 400 is not transmitted to the color ink deposition unit 300, problems of this kind can be resolved.

Fixing Unit

The fixing unit 500 fixes the resin component contained in the ink aggregate formed on the recording paper 12, to the recording paper 12. This fixing unit 500 comprises: a conveyance drum 510 which conveys the recording paper 12; a fan heater unit 512 which blows a heated air flow onto the front surface of the recording paper 12 that is conveyed by the conveyance drum 510; and a heating and pressing unit 514 which heats and presses the recording paper 12 against the conveyance drum 510.

The conveyance drum 510 is formed in a round cylindrical shape, and is supported rotatably by means of a rotational axle thereof being supported axially on bearings (not illustrated). Gripping claws 520A and 520B are provided at mutually opposing positions on the outer circumferential surface (suction surface) of the conveyance drum 510. The leading end portion of the recording paper 12 is gripped by these gripping claws 520A and 520B and the recording paper 12 is conveyed by being wrapped about the outer circumferential surface of the conveyance drum 510.

A rotational drive force is applied to the rotational axle of the conveyance drum 510 from a rotational drive device (for example, a motor) which is not illustrated, thereby causing the conveyance drum 510 to rotate towards the left (counterclockwise direction) in FIG. 1.

The fan heater unit 512 is disposed so as to oppose the outer circumferential surface of the conveyance drum 510 and blows a heated air flow toward the outer circumferential surface of the conveyance drum 510. The composition of the fan heater unit 512 is the same as the composition of the fan heater unit 214 which is provided in the treatment liquid drying unit 200. In other words, it is constituted by an infrared heater, a fan and a reflector, and by blowing air heated by the infrared heater toward the conveyance drum 510, a heated air flow is blown onto the front surface of the recording paper 12 which is conveyed by the conveyance drum 510.

The pressing and heating unit 514 is provided to the downstream side of the fan heater unit 512 and simultaneously heats and presses the recording paper 12 against the conveyance drum 510, thereby melting and pressurizing the resin component contained in the ink aggregate and fixing same to the recording paper 12. The heating and pressing unit 514 is constituted by three pressing heat rollers 514A, 514B and 514C.

The pressing heat rollers 514A, 514B and 514C are provided in parallel with the rotational axle of the conveyance drum 510, and are disposed at uniform intervals following the outer circumferential surface of the conveyance drum 510. The outer circumferential surface of the drum is pressed and abutted against the outer circumferential surface of the conveyance drum 510.

Furthermore, the pressing heat rollers 514A, 514B and 514C are provided with internal heaters, by means of which the surfaces of the rollers are heated to a prescribed temperature.

The recording paper 12 passes through the pressing heat rollers 514A, 514B and 514C in the course of being conveyed by the conveyance drum 510, during which the recording paper is heated and pressed at a prescribed temperature and a prescribed pressure by the pressing heat rollers 514A, 514B and 514C. By heating and pressurizing the paper at a prescribed temperature and a prescribed pressure by means of these pressing heat rollers 514A, 514B and 514C, the resin component contained in the ink aggregate is melted and pressurized, and the image formed on the surface of the paper is fixed to the recording paper 12.

As described above, the fixing unit 500 is constituted by a conveyance drum 510, a fan heater unit 512 and a heating and pressing unit 514, and fixes the image formed on the surface of the paper to the recording paper 12, by blowing a heated air flow from the fan heater unit 512 onto the front surface of the recording paper 12 which is conveyed by the conveyance drum 510, as well as heating and pressurizing the recording paper by means of the pressing heat rollers 514A, 514B and 514C of the heating and pressing unit 514. By this means, the wearability is improved, and the occurrence of wrinkling or curling of the recording paper can be suppressed.

In the present embodiment, the recording paper 12 is heated and pressurized by using three pressing heat rollers 514C, 514B and 514C, but the number of pressing heat rollers 514A, 514B and 514C is not limited to this, and may be increased or decreased as appropriate.

Furthermore, if the recording paper 12 is heated and pressurized by using a plurality of pressing heat rollers as in the present embodiment, then fixing properties can be improved by setting the temperatures of the respective pressing heat rollers to a higher temperature on the upstream side in terms of the conveyance direction. In the present embodiment, the temperatures are set so as to decline sequentially from the pressing heat roller 514A, to the pressing heat roller 514B to the pressing heat roller 514C.

Furthermore, in the present embodiment, a composition is adopted in which the recording paper 12 is conveyed by a conveyance drum 510, but it is also possible to convey the recording paper 12 on a flat conveyance surface.

However, by adopting a composition where the recording paper 12 is conveyed by a conveyance drum 510 as in the present embodiment, it is possible effectively to eliminate curl of the recording paper 12 which occurs in the solvent drying unit 400. In other words, by using a conveyance drum 510 which constitutes a circular arc-shaped conveyance path, it is possible to bend the recording paper 12 in a direction which corrects the curl of the recording paper 12 generated in the solvent drying unit 400 (the opposite direction to the direction of curl), whereby the curl produced in the solvent drying unit 400 can be eliminated effectively.

The recording paper 12 which has been heated and pressurized by the fixing unit 500 is conveyed to downstream processing steps via the guide roller 522. In the downstream processing steps, the region outside the image forming region is cut, or the like, and the paper is then output to a prescribed paper output unit.

Conveyance System

Figure 17:
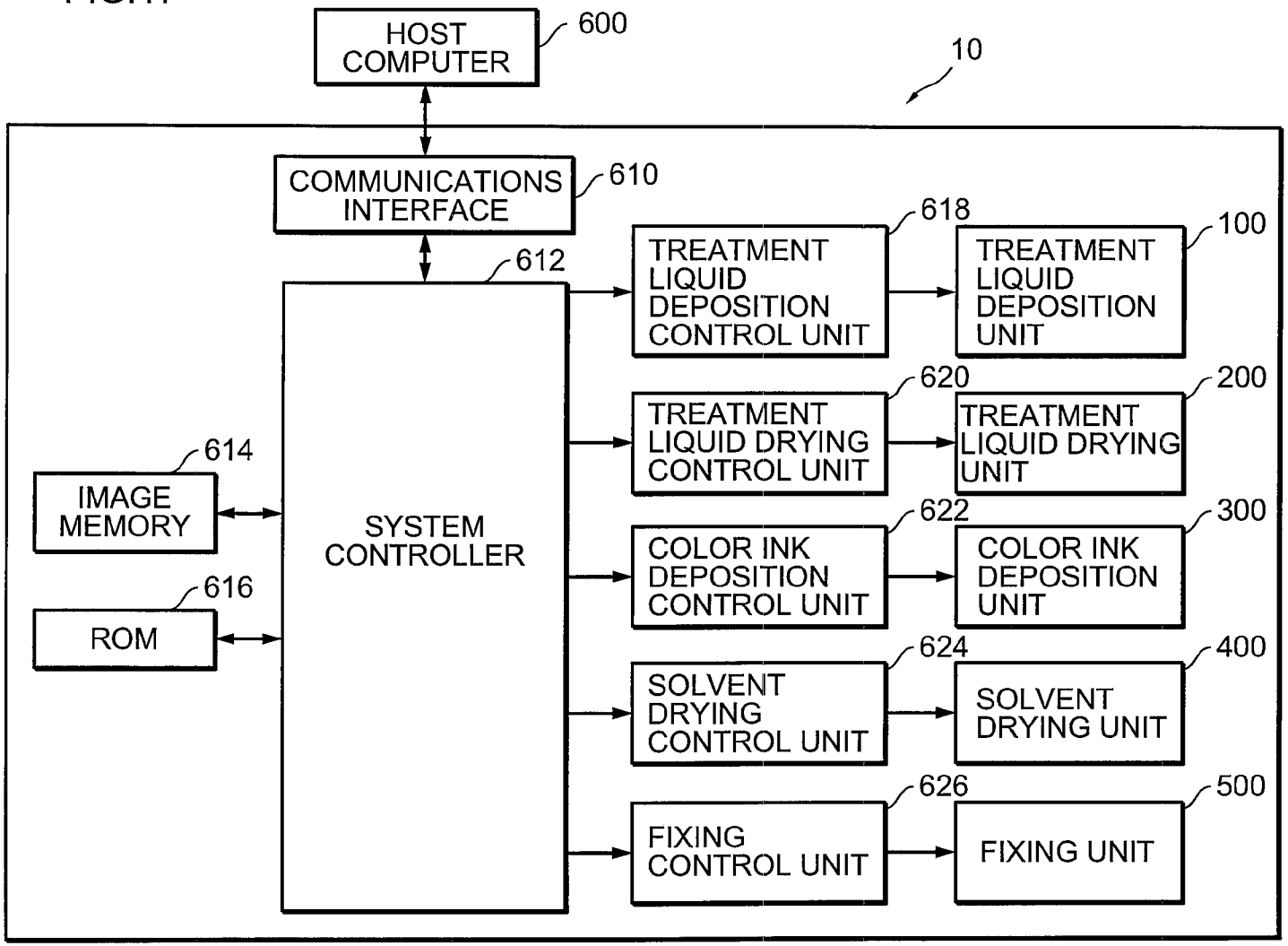
FIG. 17 is a principal block diagram of the control system of an image forming apparatus.

FIG. 17 is a principal block diagram of the control system of the image forming apparatus 10. As illustrated in FIG. 17, the image forming apparatus 10 comprises: a communications interface 610, a system controller 612, an image memory 614, a ROM 616, a treatment liquid deposition control unit 618, a treatment liquid drying control unit 620, a color ink deposition control unit 622, a solvent drying control unit 624, a fixing control unit 626, and the like.

The communications interface 610 is an interface unit for receiving image data which is transmitted by a host computer 600. Image data sent by the host computer 600 is read in to the inkjet recording apparatus 10 via this communications interface 610.

The image memory 614 is a storage device which temporarily stores an image input via the communications interface 610, and data is read from and written to the image memory 614 via the system controller 612.

The system controller 612 is a control unit which controls the respective units of the image forming apparatus 10 and comprises a CPU, ROM, RAM, and the like. This system controller 612 controls the respective sections of image forming apparatus 10 in accordance with a prescribed control program. A control program which is executed by the system controller is stored in the ROM 616.

The treatment liquid deposition control unit 618 controls the driving of the treatment liquid deposition unit 100 in accordance with instructions from the system controller 612. In other words, the treatment liquid deposition control unit 618 controls the driving of the suction drum 110 provided in the treatment liquid deposition unit 100, the treatment liquid application unit 140, the application roller exchanging apparatus 152, and the like.

The treatment liquid drying control unit 620 controls the driving of the treatment liquid drying unit 200 in accordance with instructions from the system controller 612. In other words, the treatment liquid drying control unit 620 controls the driving of the heater 216 of the heating conveyance surface 210, the conveyance apparatus 212 and the fan heater unit 214, which are provided in the treatment liquid drying unit 200.

The color ink deposition control unit 622 controls the driving of the color ink deposition unit 300, in accordance with instructions from the system controller 612. In other words, the color ink deposition control unit 622 controls the driving of the suction drum 310, the recording heads 360C, 360M, 360Y and 360K which are provided in the color ink deposition unit 300. More specifically, the color ink deposition control unit 622 is provided with a signal processing function for generating a print control signal from the image data input from the host computer 600 and a head driver, or the like, which drives the recording heads 360C, 360M, 360Y and 360K on the basis of the generated print control signal (dot data). The head driver generates drive signals for driving the piezoelectric elements of the recording heads of the respective colors on the basis of the generated dot data and supplies the generated drive signals to the piezoelectric elements. Consequently, ink droplets are ejected from the recording heads 360C, 360M, 360Y and 360K of the respective colors.

The solvent drying control unit 624 controls the driving of the solvent drying unit 400 in accordance with instructions from the system controller 612. In other words, the solvent drying control unit 624 controls the driving of the heater 416 of the heating conveyance surface 410, the conveyance apparatus 412 and the fan heater unit 414, which are provided in the solvent drying unit 400.

The fixing control unit 626 controls the driving of the fixing unit 500 in accordance with instructions from the system controller 612. In other words, the fixing control unit 626 controls the driving of the conveyance drum 510, the fan heater unit 512 and the heating and pressing unit 514 which are provided in the fixing unit 500.

Sequence of Image Forming Process

The sequence of the process of image formation by the image forming apparatus 10 according to the present embodiment will now be described in general terms.

Recording paper 12 supplied from a paper supply unit (not illustrated) is transferred to the suction drum 110 of the treatment liquid deposition unit 100 via the guide roller 160.

The suction drum 110 takes up the paper by gripping the leading end of the recording paper 12 by means of the gripping claw 138A (or 138B). Thereupon, by rotating the suction drum while suctioning air from the suction holes formed in the outer circumferential surface of the drum, the recording paper 12 is wrapped about the outer circumferential surface and conveyed under suction. The recording paper 12 makes contact with the application roller during the course of this conveyance, whereby treatment liquid is applied to the front surface of the recording paper.

The recording paper 12 to which treatment liquid has been applied is received by the conveyance apparatus 212 of the treatment liquid drying unit 200, from the suction drum 110 of the treatment liquid deposition unit 100.

The conveyance apparatus 212 grips the leading end of the recording paper 12 and conveys the recording paper 12 along a prescribed conveyance path. As the recording paper 12 is conveyed by this conveyance apparatus 212, the paper slides and moves over the heating conveyance surface 210, which is heated. Furthermore, a heated air flow is blown onto the front surface of the paper from a fan heater unit 214 during the course of this conveyance. By this means, the solvent component (liquid component) of the treatment liquid which has been applied to the surface of the paper dries (evaporates off) and a solid or semi-solid layer of aggregating treatment agent is formed on the recording paper 12.

The recording paper 12 on which the treatment liquid has been dried is then transferred to the suction drum 310 of the color ink deposition unit 300 from the conveyance apparatus 212 of the treatment liquid drying unit 200.

The suction drum 310 takes up the paper by gripping the leading end of the recording paper 12 by means of the gripping claw 338A (or 338B). Thereupon, by rotating the suction drum while suctioning air from the suction holes formed in the outer circumferential surface of the drum, the recording paper 12 is wrapped about the outer circumferential surface and conveyed under suction. An image is formed on the recording paper 12 by ejecting droplets of color inks onto the surface thereof from the recording heads 360C, 360M, 360Y and 360K during the course of this conveyance.

Here, since an aggregating treatment agent layer is formed on the front surface of the recording paper 12, then when ink droplets are ejected onto the recording paper 12, the coloring material in the ink is aggregated by the action of the aggregating agent. As a result of this, an ink aggregate (coloring material aggregate) is formed on the recording paper 12. Furthermore, the ink solvent which has separated from the coloring material spreads on the recording paper 12, and a liquid layer in which the aggregating treatment agent is dissolved is formed.

The recording paper 12 on which an image has been formed by depositing color inks is transferred from the suction drum 310 of the color ink deposition unit 300 to the conveyance apparatus 412 of the solvent drying unit 400.

The conveyance apparatus 412 grips the leading end of the recording paper 12 and conveys the recording paper 12 along a prescribed conveyance path. As the recording paper 12 is conveyed by this conveyance apparatus 412, the paper slides and moves over the heating conveyance surface 410, which is heated. Furthermore, a heated air flow is blown onto the front surface of the paper from a fan heater unit 414 during the course of this conveyance. By this means, the ink solvent remaining on the surface is dried (evaporated) and removed.

The recording paper 12 from which the ink solvent has been removed is transferred from the conveyance apparatus 412 of the solvent drying unit 400 to the conveyance drum 510 of the fixing unit 500.

The conveyance drum 510 takes up the paper by gripping the leading end of the recording paper 12 by means of the gripping claw 520A (or 520B). As the drum is rotated, the recording paper 12 is wrapped about the outer circumferential surface of the drum and conveyed. During the course of this conveyance, a heated air flow is blown onto the front surface of the paper from the fan heater unit 512, and the recording paper 12 is heated and pressurized by the pressing heat rollers 514A, 514B and 514C of the heating and pressing unit 514. Accordingly, the resin component contained in the ink aggregate is melted and pressurized and the image formed on the surface of the paper is fixed to the recording paper 12.

Relationship Between Suction Holes Formed In Suction Drum Of Treatment Liquid Deposition Unit And Suction Holes Formed In Suction Drum Of Color Ink Deposition Unit As described above, in the image forming apparatus 10 according to the present embodiment, in order to reduce image non-uniformity caused by non-uniformities in the reaction between the treatment liquid and the ink, the suction holes 124 formed in the outer circumferential surface of the suction drum 110 of the treatment liquid deposition unit 100 and the suction holes 324 formed in the outer circumferential surface of the suction drum 310 of the color ink deposition unit 300 are formed in mutually different modes. In other words, the suction holes are formed by adjusting their position, size, shape, and the like, in such a manner that when the recording paper 12 is held by suction, it is suctioned at mutually different positions by the respective suction holes.

Figures 18A, 18B, 18C:
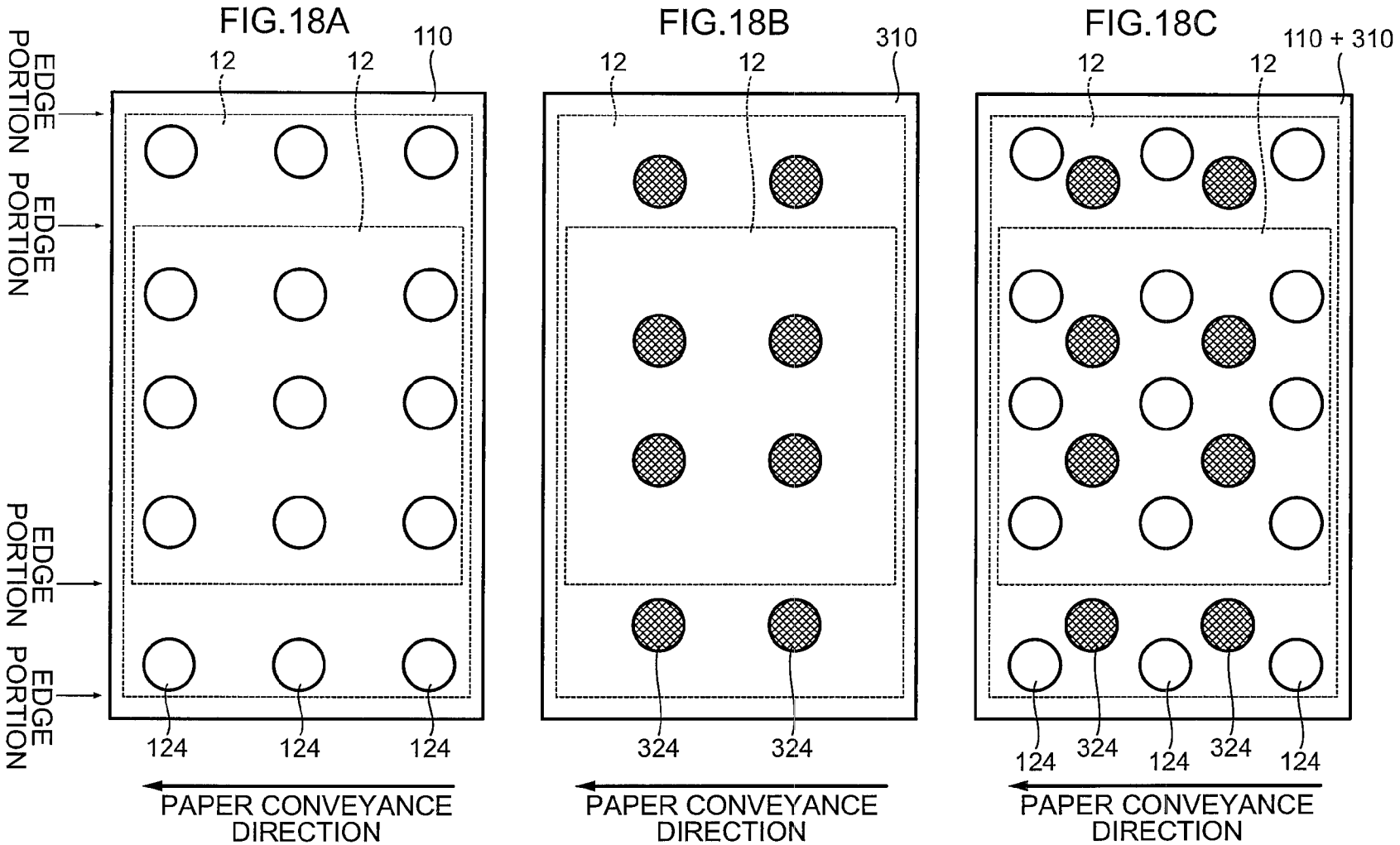
FIGS. 18A to 18C are diagrams illustrating one example of the formation patterns of the suction holes formed in the outer circumferential surface of a suction drum of the treatment liquid deposition unit and the suction holes formed in the outer circumferential surface of the suction drum of the color ink deposition unit (no overlapping portions)

FIGS. 18A to 18C illustrate one example of the formation pattern of suction holes 124 formed in the outer circumferential surface of the suction drum 110 of the treatment liquid deposition unit 100 and suction holes 324 formed in the outer circumferential surface of the suction drum 310 of the color ink deposition unit 300.

FIG. 18A illustrates the formation pattern of the suction holes 124 formed in the outer circumferential surface of the suction drum 110 of the treatment liquid deposition unit 100, and FIG. 18B illustrates the formation pattern of the suction holes 324 formed in the outer circumferential surface of the suction 310 of the color ink deposition unit 300. Furthermore, FIG. 18C illustrates the arrangement layout of the respective suction holes when the outer circumferential surfaces of both suction drums are mutually overlapping.

As illustrated in FIG. 18A, circular suction holes 124 are arranged at a uniform interval in the direction of conveyance of the recording paper 12 and are also arranged at a uniform interval in the direction perpendicular to the direction of conveyance of the recording paper 12, in the suction drum 110 of the treatment liquid deposition unit 100.

As illustrated in FIG. 18B, circular suction holes 324 are arranged at a uniform interval in the direction of conveyance of the recording paper 12 and are also arranged at uniform interval in the direction perpendicular to the direction of conveyance of the recording paper 12, in the suction drum 310 of the color ink deposition unit 300, but as illustrated in FIG. 18C, the suction holes 324 are arranged so as to create no overlap with the suction holes 124 formed in the suction drum 110 of the treatment liquid deposition unit 100. More specifically, the rows of suction holes 324 of the suction drum 310 of the color ink deposition unit 300 are arranged between the respective rows of the suction holes 124 which are formed in the suction drum 110 of the treatment liquid deposition unit 100. The arrangement density is dense in the central portion in the breadthways direction (the direction perpendicular to the conveyance direction) and sparse in the outer sides. Furthermore, no suction holes are positioned in the edge portions of the recording paper 12.

By forming the suction holes and staggering their respective suction positions in this way, it is possible to prevent non-uniformities in the deposition of the treatment liquid from being superimposed with non-uniformities in the deposition of the ink, and therefore image non-uniformities resulting from non-uniformity in the reaction between the treatment liquid and the ink can be reduced.

In the present embodiment, since the suction drum 110 of the treatment liquid deposition unit 100 conveys the recording paper 12 by gripping the leading end of the recording paper 12 with a gripping claw 138A, 138B, then provided that the recording paper 12 is of the same size, the same positions on the paper are always suctioned by the suction holes 124. More specifically, since the gripping position of the recording paper 12 is specified by the gripping claws 138A and 138B, then the recording paper 12 is always held at a uniform position on the suctioning surface of the suction drum 110.

In the suction drum 310 of the color ink deposition unit 300, similarly, the leading end of the recording paper 12 is gripped and conveyed by the gripping claws 338A, 338B, and therefore provided that the recording paper 12 is of the same size, the same positions on the paper are always suctioned by the suction holes 324. More specifically, since the gripping position of the recording paper 12 is specified by the gripping claws 338A and 338B, then the recording paper 12 is always held at a uniform position on the suctioning surface of the suction drum 310.

Consequently, by laying out the suction holes of the respective suction drums so as to avoid mutual overlapping of the suction holes, by taking the positions of the gripping claws as a reference, it is possible to convey the paper while staggering the suction positions during the deposition of treatment liquid and the suction positions during the deposition of ink.

The arrangement layout of the suction holes 124 formed in the suction drum 110 of the treatment liquid deposition unit 100 and the arrangement layout of the suction holes 324 formed in the suction drum 310 of the color ink deposition unit 300 are not limited in particular to those described above. It is possible to arrange the suction holes in a variety of layouts, provided that the respective suction positions on the recording paper 12 do not overlap with each other.

Therefore, it is desirable that the suction holes should be arranged in an optimal configuration, appropriately, by taking account of the type, size, holding properties, and the like, of the recording paper 12 which is being conveyed.

If the holding properties of the recording paper 12 are taken into account, then it is desirable that the suction holes should be disposed in such a manner that they have a high arrangement density in the central portion in the breadthways direction (the direction perpendicular to the conveyance direction) and a sparse arrangement density in the outer sides. Furthermore, even in cases where recording papers 12 of different sizes are conveyed, it is desirable that suction holes should not be disposed in the edge portions of the paper (to avoid suctioning of the edge portions of the paper).

Furthermore, it is not strictly necessary to impose restrictions on the arrangement of the suction holes, and they may be arranged in a random fashion.

Moreover, the shape of the suction holes is not limited to being a circular shape, and it is also possible to employ various other shapes, such as an elliptical shape, triangular shape, quadrilateral shape, star shape, or the like.

Furthermore, rather than using the same shape, it is also possible to combine the use of various different shapes, and to form the suction holes to various different sizes.

Furthermore, it is also possible to form suction holes of different shapes in the suction drum 110 of the treatment liquid deposition unit 100 and the suction drum 310 of the color ink deposition unit 300.

FIGS. 19A to 21C respectively illustrate other examples of the formation pattern of suction holes 124 formed in the outer circumferential surface of the suction drum 110 of the treatment liquid deposition unit 100 and suction holes 324 formed in the outer circumferential surface of the suction drum 310 of the color ink deposition unit 300.

Figure 19A:
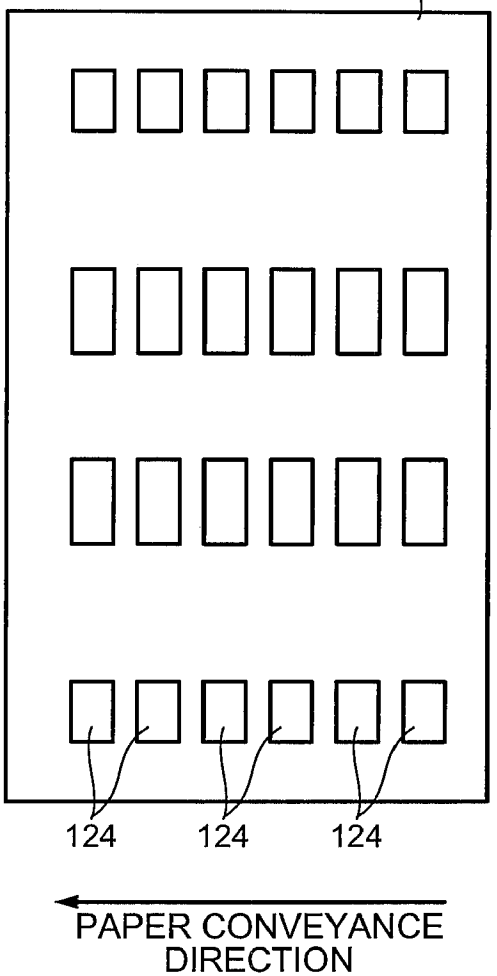
FIGS. 19A to 19C are diagrams illustrating a further example of the formation patterns of the suction holes formed in the outer circumferential surface of a suction drum of the treatment liquid deposition unit and the suction holes formed in the outer circumferential surface of the suction drum of the color ink deposition unit (no overlapping portions)
Figure 19B:
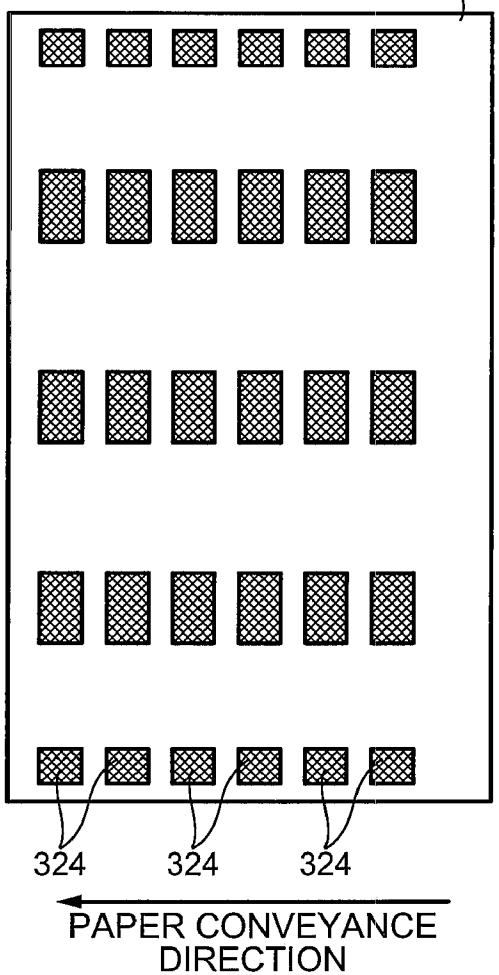
Figure 19C:
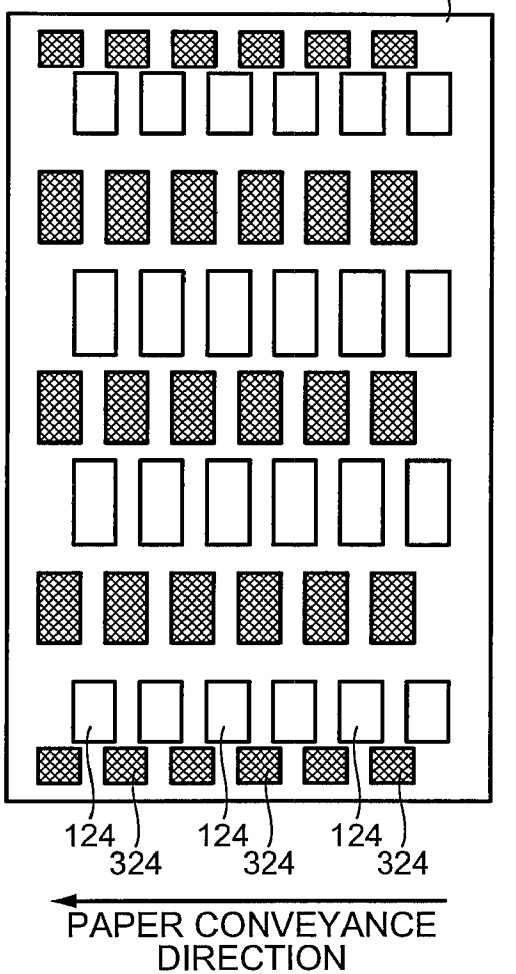
Figure 20A:
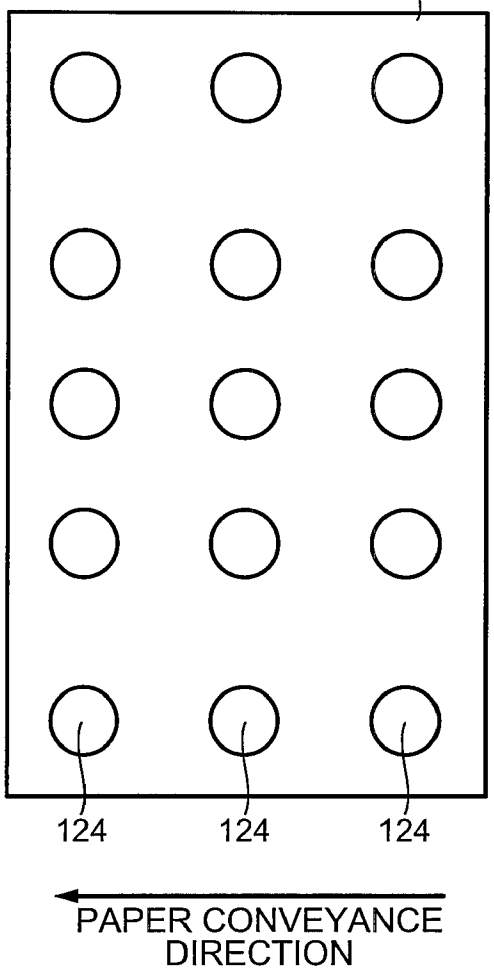
FIGS. 20A to 20C are diagrams illustrating a further example of the formation patterns of the suction holes formed in the outer circumferential surface of a suction drum of the treatment liquid deposition unit and the suction holes formed in the outer circumferential surface of the suction drum of the color ink deposition unit (no overlapping portions)
Figure 20B:
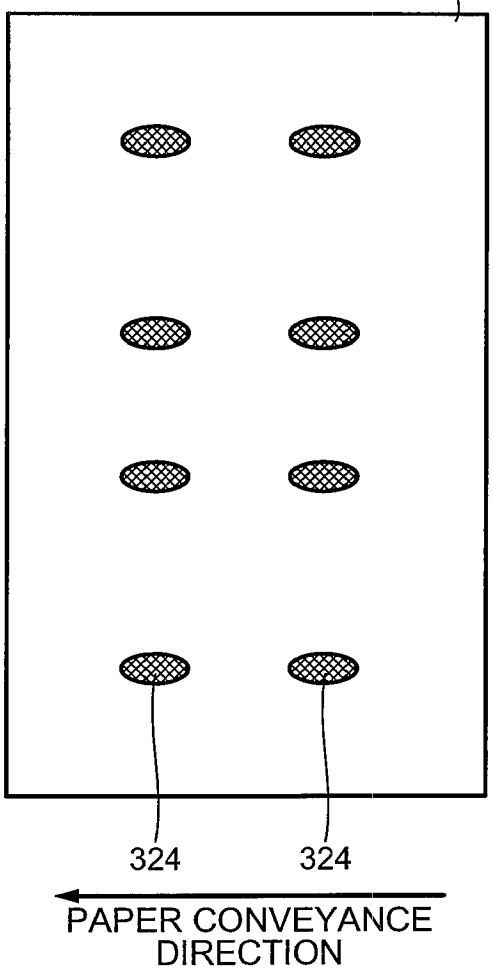
Figure 20C:
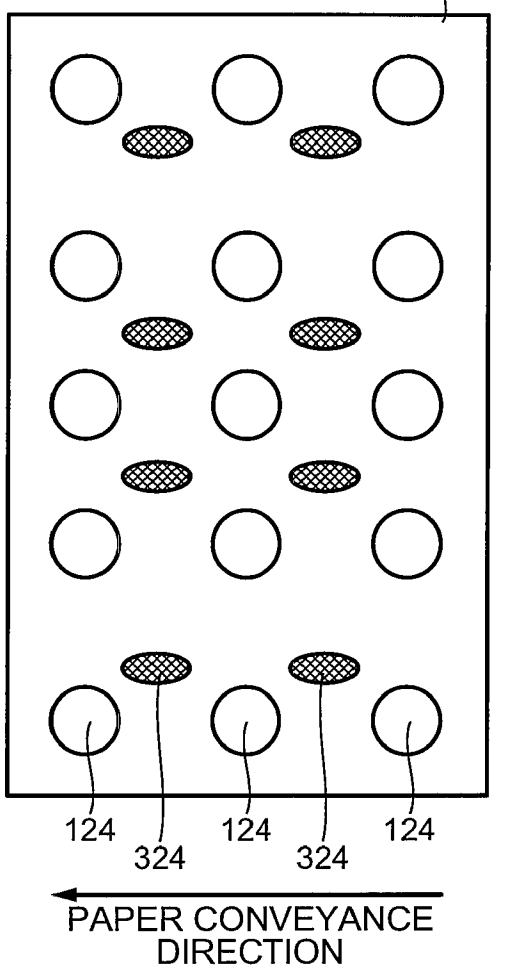
Figure 21A:
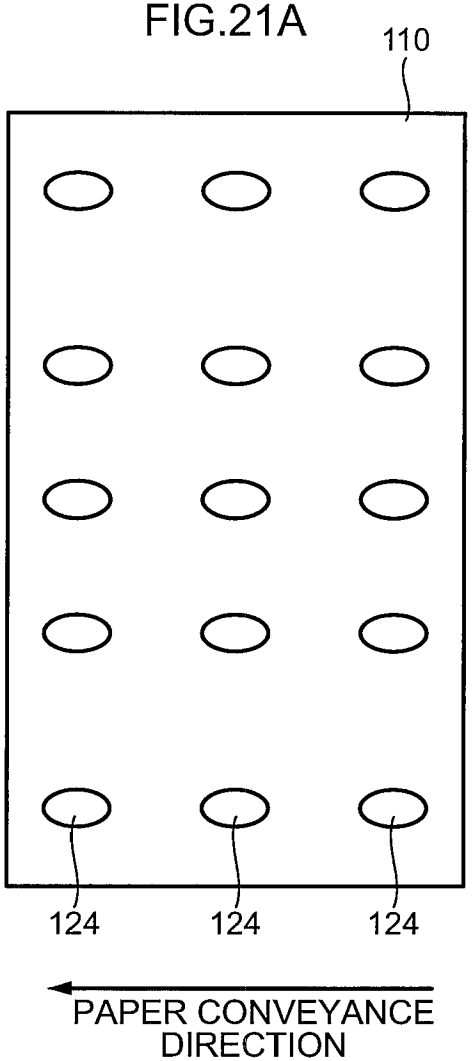
FIGS. 21A to 21C are diagrams illustrating a further example of the formation patterns of the suction holes formed in the outer circumferential surface of a suction drum of the treatment liquid deposition unit and the suction holes formed in the outer circumferential surface of the suction drum of the color ink deposition unit (no overlapping portions)
Figure 21B:
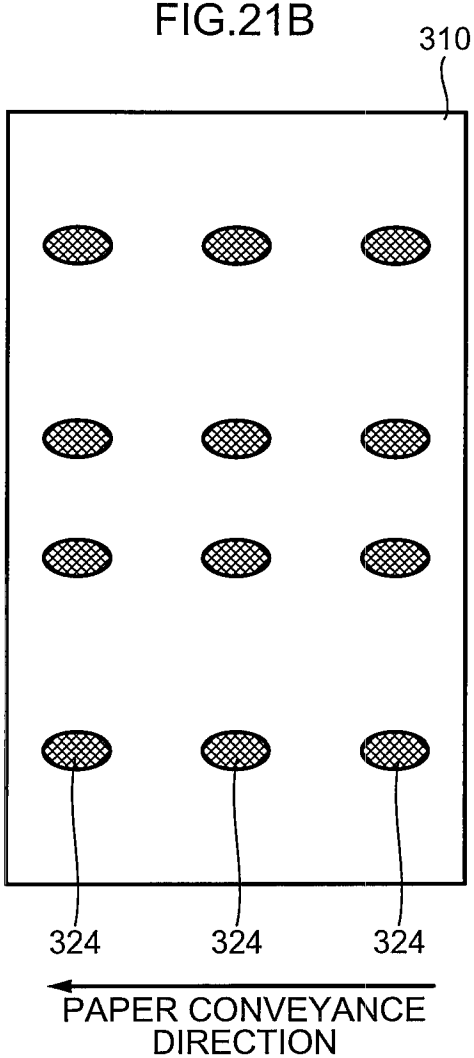

In each of these sets of drawings, FIGS. 19A, 20A and 21A illustrate the formation pattern of the suction holes 124 formed in the outer circumferential surface of the suction drum 110 of the treatment liquid deposition unit 100, and FIGS. 19B, 20B and 21B illustrate the formation pattern of the suction holes 324 formed in the outer circumferential surface of the suction 310 of the color ink deposition unit 300. Furthermore, FIGS. 19C, 20C and 21C illustrate the arrangement layout of the respective suction holes when the outer circumferential surfaces of both suction drums are superimposed on each other.

In FIGS. 19A to 19C, square-shaped suction holes 124, 324 are formed respectively in the suction drum 110 of the treatment liquid deposition unit 100 and the suction drum 310 of the color ink deposition unit 300.

Furthermore, in FIGS. 20A to 20C, round suction holes 124 are formed in the suction drum 110 of the treatment liquid deposition unit 100 and elliptical suction holes 324 are formed in the suction drum 310 of the color ink deposition unit 300.

Figure 21C:
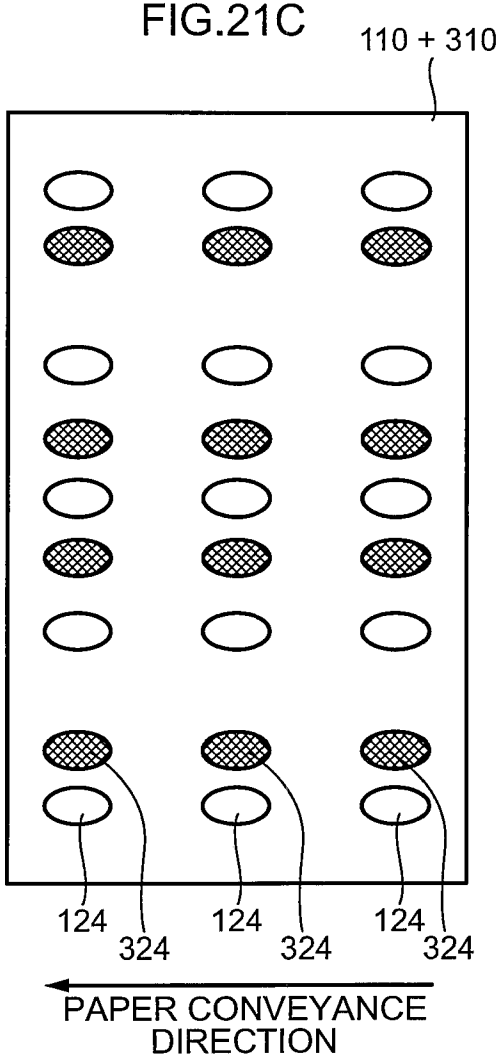
Figure 22A:
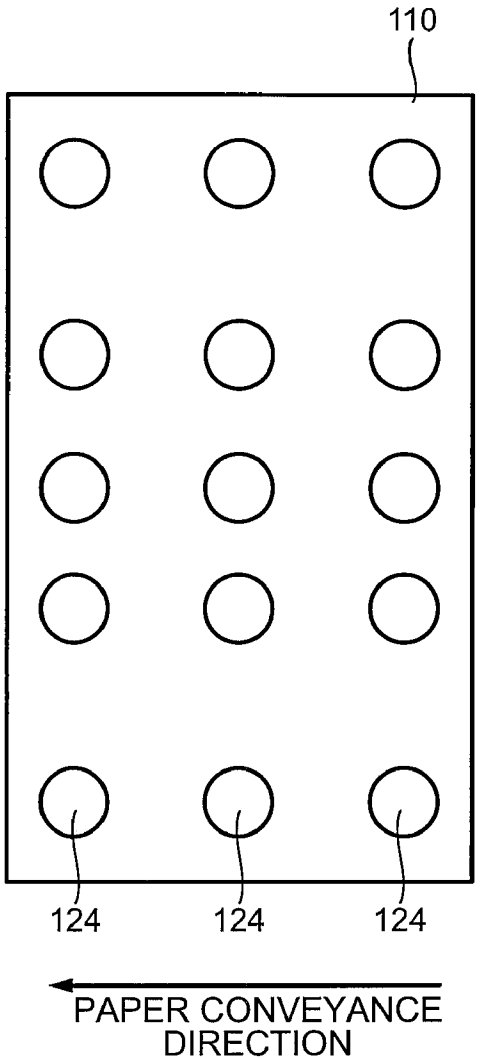
FIGS. 22A to 22C are diagrams illustrating a further example of the formation patterns of the suction holes formed in the outer circumferential surface of a suction drum of the treatment liquid deposition unit and the suction holes formed in the outer circumferential surface of the suction drum of the color ink deposition unit (overlapping portions exist)
Figure 22B:
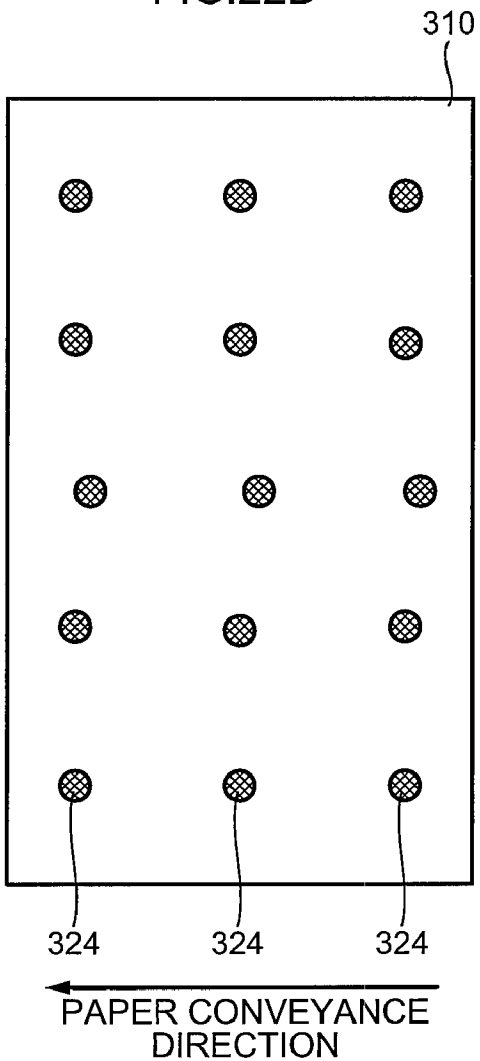
Figure 22C:
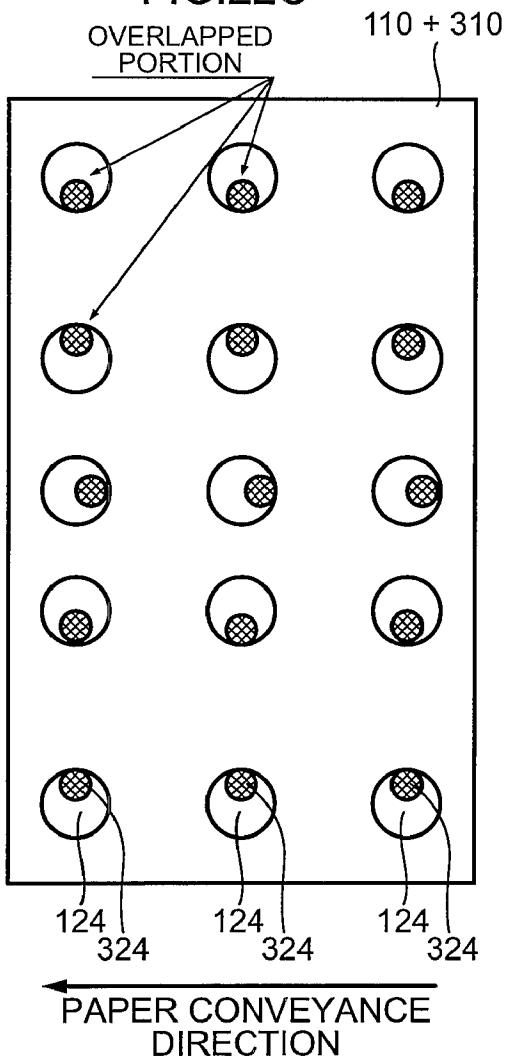
Figure 23C:
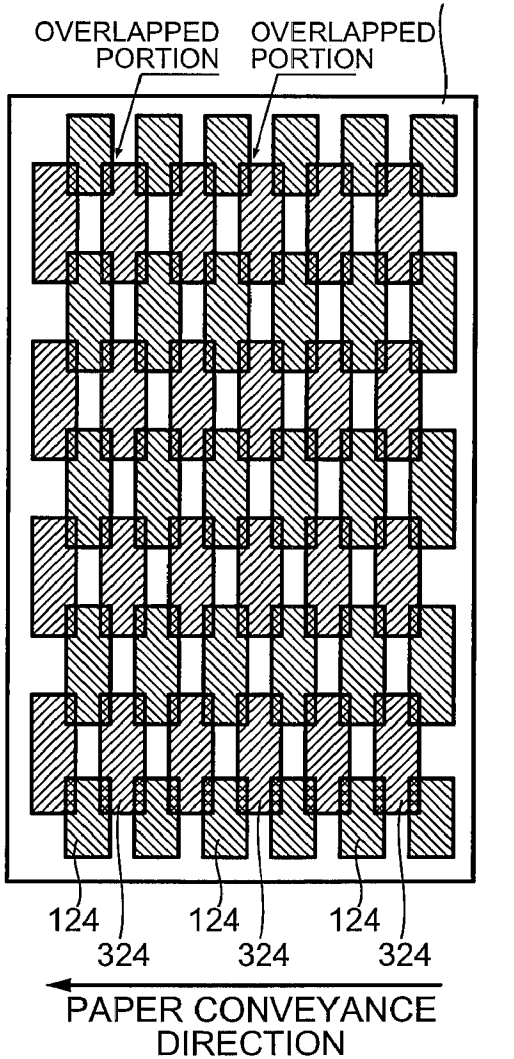
FIGS. 23A to 23C are diagrams illustrating a further example of the formation patterns of the suction holes formed in the outer circumferential surface of a suction drum of the treatment liquid deposition unit and the suction holes formed in the outer circumferential surface of the suction drum of the color ink deposition unit (overlapping portions exist)
Figure 23B:
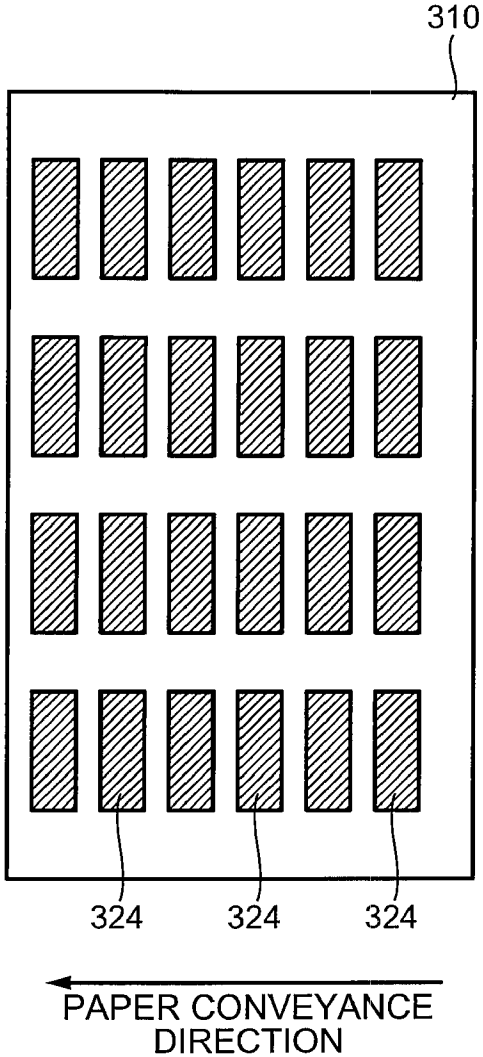
Figure 23A:
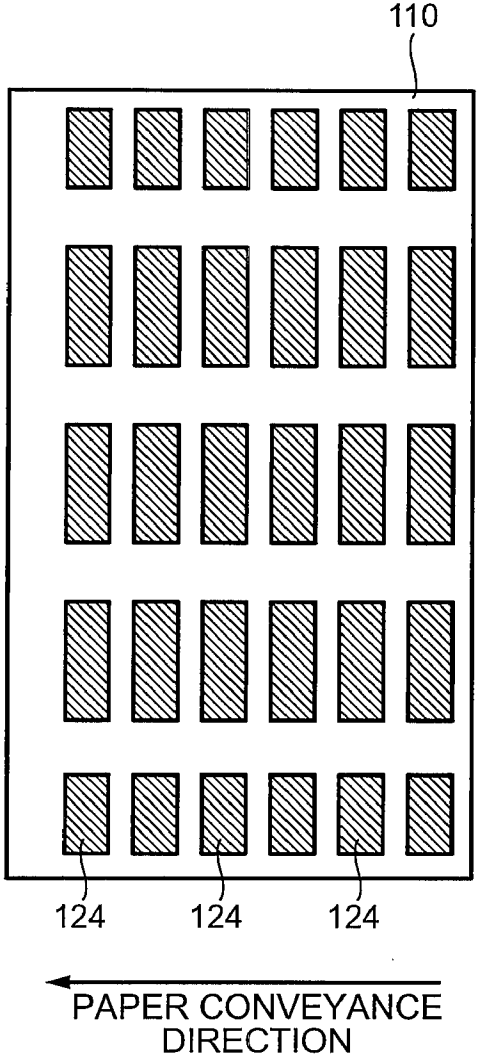
Figure 24A:
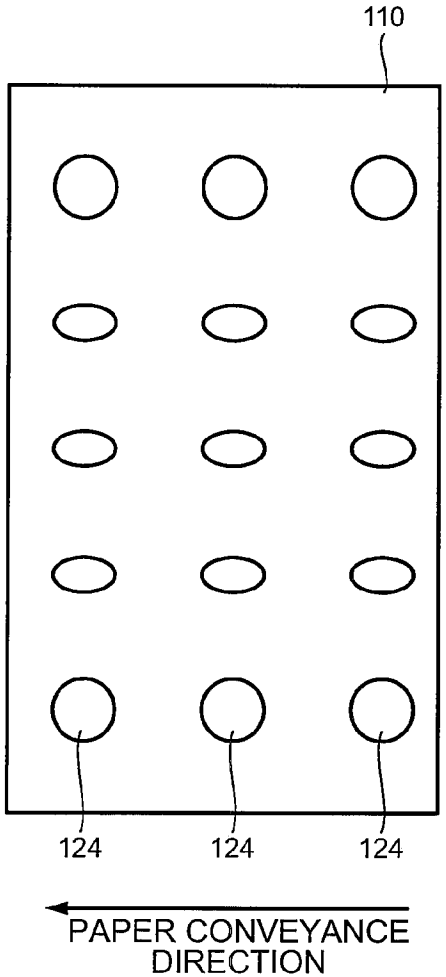
FIGS. 24A to 24C are diagrams illustrating a further example of the formation patterns of the suction holes formed in the outer circumferential surface of a suction drum of the treatment liquid deposition unit and the suction holes formed in the outer circumferential surface of the suction drum of the color ink deposition unit (overlapping portions exist)
Figure 24B:
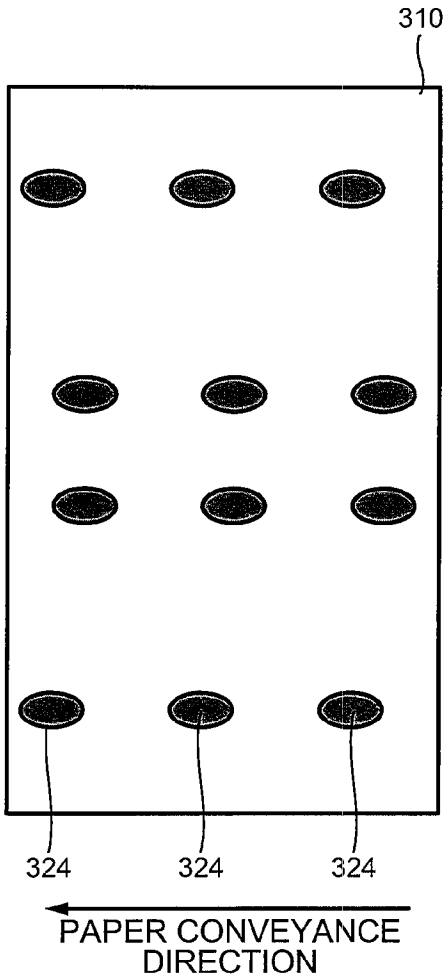
Figure 24C:
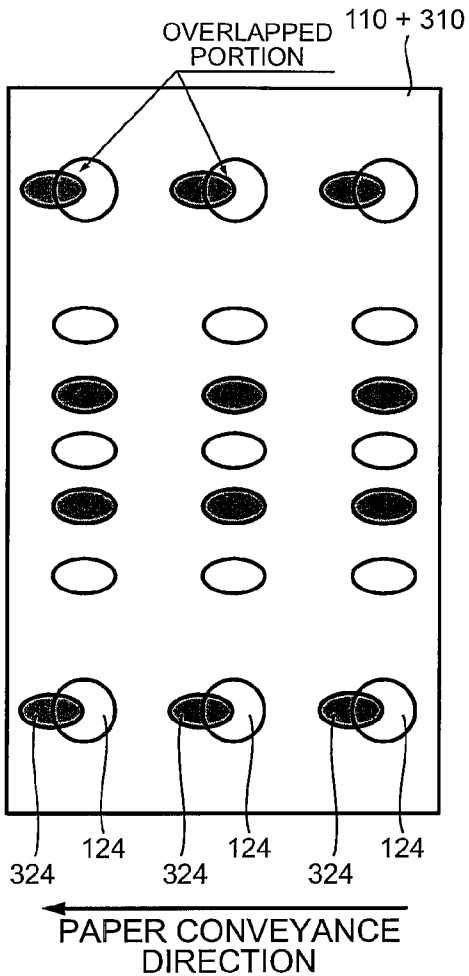
Figure 25A:
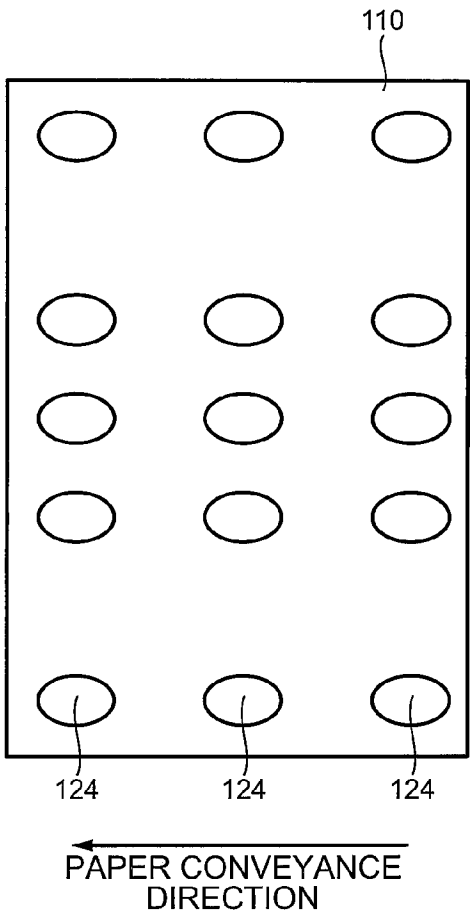
FIGS. 25A to 25C are diagrams illustrating a further example of the formation patterns of the suction holes formed in the outer circumferential surface of a suction drum of the treatment liquid deposition unit and the suction holes formed in the outer circumferential surface of the suction drum of the color ink deposition unit (overlapping portions exist)
Figure 25B:
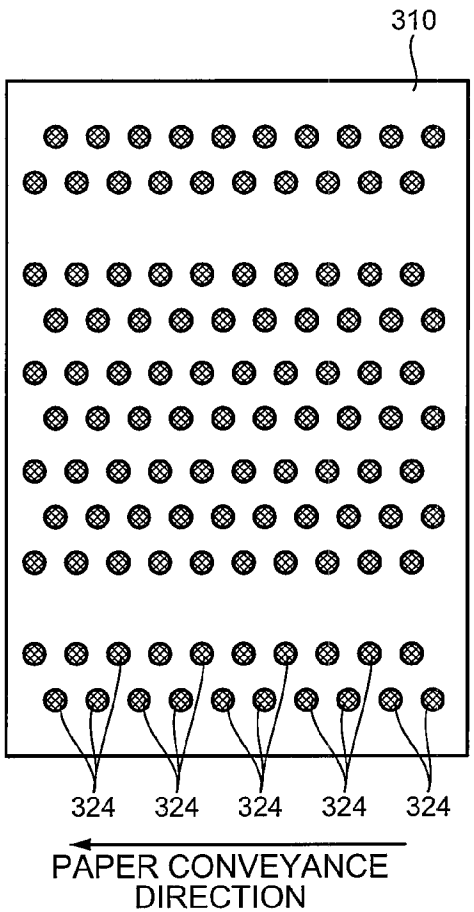
Figure 25C:
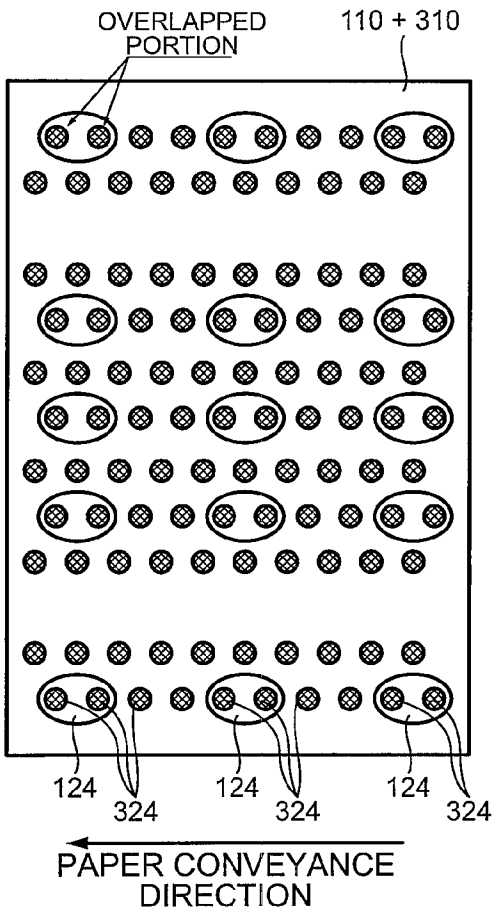

Moreover, in FIGS. 21A to 21C, elliptical suction holes 124, 324 are formed respectively in the suction drum 110 of the treatment liquid deposition unit 100 and the suction drum 310 of the color ink deposition unit 300.

In each of the cases illustrated in FIGS. 19A to 21C, the suction holes are formed at a high arrangement density in the central portion in the breadthways direction, and a sparse arrangement density at the outer sides. Furthermore, the suction holes are arranged so as not to be positioned at the edge portions of the recording paper, even in cases where recording papers 12 of different sizes are conveyed.

As described above, desirably, the suction holes 124 formed in the suction drum 110 of the treatment liquid deposition unit 100, and the suction holes 324 formed in the suction drum 310 of the color ink deposition unit 300 are arranged in such a manner that they suction mutually different positions on the recording paper 12, but even if the suction positions are partially overlapping, as illustrated in FIGS. 22A to 25C, it is still possible to achieve similar beneficial effects by satisfying necessary conditions. These conditions are described below.

FIG. 26 is a table illustrating the results of visual evaluation of image non-uniformities when images were formed while varying the conditions of overlap of the suction positions.

Here, respective images were formed at different values of (1) the ratio of the surface area of the overlapping portion with respect to the surface area of the larger suction hole, in each of the overlapping portions ([surface area of overlapping portions/surface area of larger suction holes]×100%) and (2) the ratio of the surface area of the overlapping portions with respect to the potential image formation surface area of the recording paper; the non-uniformities in the images thus formed were evaluated visually.

Here, the "larger suction hole in each of the overlapping portions" in condition (1) means the suction hole having the largest opening surface area, of a suction hole 124 and a suction hole 324 which have overlapping suction positions. Furthermore, the "ratio of the surface area of the overlapping portion with respect to the surface area of the larger suction hole, in each of the overlapping portions" means the ratio of the surface area of the overlapping portion with respect to the opening surface area of the suction hole having the larger opening surface area, in a suction hole 124 and a suction hole 324 which have overlapping suction positions. For example, in the example in FIGS. 22A to 22C, the suction holes 124 formed in the suction drum 110 of the treatment liquid deposition unit 100 are larger than the suction holes 324 formed in the suction drum 310 of the color ink deposition unit 300, and all of the suction holes 324 formed in the suction drum 310 of the color ink deposition unit 300 overlap with the suction holes 124 formed in the suction drum 110 of the treatment liquid deposition unit 100. Therefore, in this case, the "surface area of the larger suction holes" is the surface area of the suction holes 124 formed in the suction drum 110 of the treatment liquid deposition unit 100, and the "surface area of the overlapping portions" is the surface area of the suction holes 324 which are formed in the suction drum 310 of the color ink deposition unit 300. Consequently, this ratio is (surface area of suction holes 324 formed in suction drum 310 of color ink deposition unit 300)/(surface area of suction holes 124 formed in suction drum 110 of treatment liquid deposition unit 100)×100%.

Furthermore, the "potential image formation surface area of the recording paper" in condition (2) above means the surface area of the image forming region set on the recording paper, and the "ratio of the surface area of the overlapping portions with respect to the potential image formation surface area of the recording paper" means the ratio of the surface area of the overlapping portions with respect to the surface area of the image forming region set on the recording paper.

In the present investigation, respective images were formed by (1) changing the ratio of the surface area of the overlapping portions with respect to the surface area of the larger suction holes to 0%, 5%, 10%, 15%, 20% and 25%, and (2) changing the ratio of the surface area of the overlapping portions with respect to the potential image forming surface area of the recording paper to 0%, 1%, 2%, 3%, 4% and 5%. Non-uniformities in the images thus formed were evaluated visually. 0% means a state where there was no overlap.

As the table indicated in FIG. 26 reveals, provided that, in each overlapping portion, (1) the ratio of the surface area of the overlapping portion with respect to the surface area of the larger suction hole is 20% or lower, and (2) the ratio of the overlapping portions with respect to the potential image formation surface area of the recording medium is 4% or lower, then even if there are overlapping portions, it is still possible to reduce image non-uniformities caused by non-uniformities in the reaction between the treatment liquid and the ink. These conditions need to be satisfied in all of the overlapping portions.

Furthermore, as the table clearly reveals, more desirably, if (1) the ratio of the surface area of the overlapping portions with respect to the surface area of the larger suction holes is 15% or lower, and (2) the ratio of the surface area of the overlapping portions with respect to the surface area of the potential image formation surface area of the recording paper is 3% or lower, and even more desirably, if (1) the ratio of the surface area of the overlapping portions with respect to the surface area of the larger suction holes is 5% or lower, and (2) the ratio of the surface area of the overlapping portions with respect to the surface area of the potential image formation surface area of the recording paper is 2% or lower, then it is possible to reduce image non-uniformities in an even more satisfactory manner.

Moreover, even if the suction positions are mutually overlapping, as in the present example, it is possible to employ various different shapes for the shape of the suction holes, for example, it is possible to use an elliptical shape, a triangular shape, a quadrilateral shape, a star shape, or the like. Furthermore, rather than using the same shape only, it is also possible combine use of various different shapes. Moreover, it is also possible to form the suction holes to various different sizes. Furthermore, it is also possible to form suction holes of different shapes in the suction drum 110 of the treatment liquid deposition unit 100 and the suction drum 310 of the color ink deposition unit 300. Moreover, it is not strictly necessary to impose restrictions on the arrangement of the suction holes, and they may be arranged in a random fashion.

If the holding properties of the recording paper 12 are taken into account, then it is desirable that the suction holes should be disposed in such a manner that they have a high arrangement density in the central portion in the breadthways direction (the direction perpendicular to the conveyance direction) and a sparse arrangement density in the outer sides, as in the present embodiment. Furthermore, desirably, the suction holes are positioned so as not to suction the edge portions of the recording paper 12.

Figures 27A, 27B, 27C, 27D:
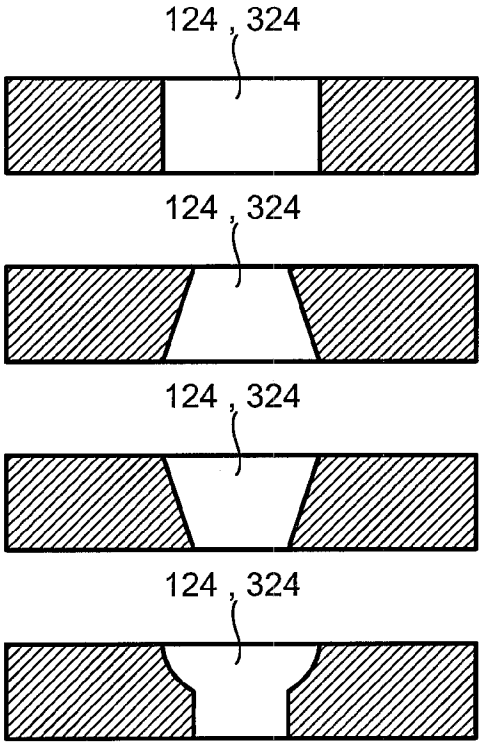
FIGS. 27A to 27D are cross-sectional diagrams illustrating examples of the cross-sectional shape of suction holes.

Furthermore, the cross-sectional shape of the suction holes can employ various different shapes, not only in cases there is overlap but also even in cases where there is no overlap. For example, the suction holes may have a straight shape as illustrated in FIG. 27A, or they may have a tapered shape as illustrated in FIGS. 27B and 27C. Furthermore, they may be formed to a shape which combines a bowl shape and a straight shape, as illustrated in FIG. 27D.

Figure 28:
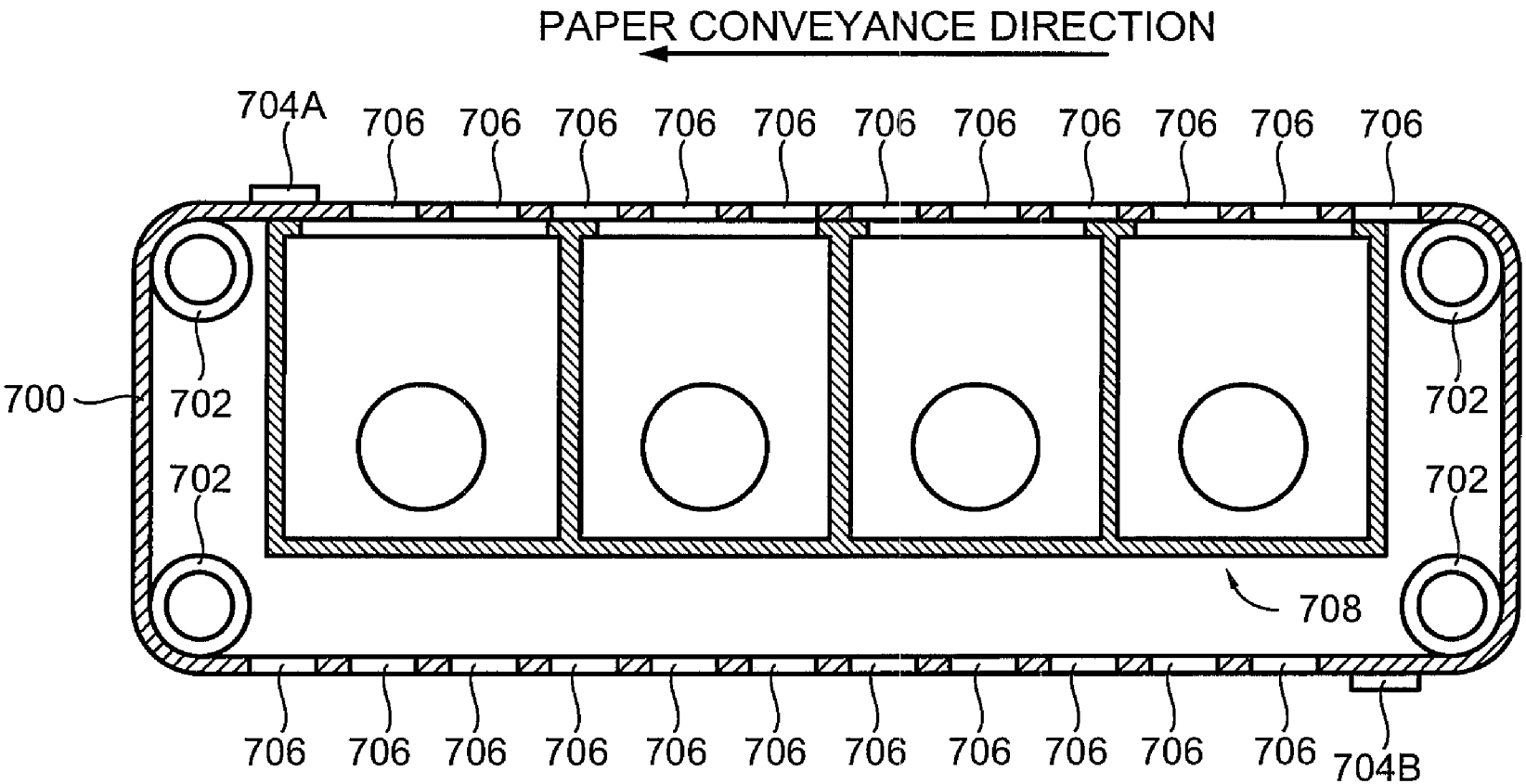
FIG. 28 is a general schematic drawing of a conveyance belt.

Furthermore, in the image forming apparatus according to the example described above, a composition is adopted in which the recording paper 12 is suctioned and conveyed by a suction drum, but as illustrated in FIG. 28, it is also possible to adopt a composition where the recording paper is suctioned and conveyed by a conveyance belt, in which case also, the suction holes of the conveyance belt of the treatment liquid deposition unit 100 and the suction holes of the conveyance belt of the color ink deposition unit 300 are formed so as not to be mutually overlapping, or if overlapping, are formed so as to satisfy the conditions described above.

The conveyance belt 700 illustrated in FIG. 28 is formed in an endless shape, and is wrapped about four guide rollers 702 so as to form a rectangular path of travel. One of the guide rollers 702 is connected to a rotational drive device (for example, a motor) which is not illustrated, and by driving the guide roller 702 so as to rotate by means of this rotational drive device, the conveyance belt 700 travels along a prescribed path of travel formed in a square shape.

Gripping claws 704A and 704B are provided at two positions on the conveyance belt 700, and the recording paper 12 is conveyed with the leading end of the recording paper 12 being gripped by these gripping claws 704A, 704B. Furthermore, the conveyance belt 700 has a plurality of suction holes 706 formed in the circumferential surface thereof, and the recording paper is suctioned and held on the front surface (suctioning surface) by suctioning air from these suction holes 706.

A suctioning apparatus 708 is disposed inside the conveyance belt 700, and air is suctioned from the suction holes 704 by means of this suctioning apparatus 708. The suctioning area of the suctioning apparatus 708 is divided up and the suctioning force is set to become weaker from the upstream side toward the downstream side in terms of the direction of conveyance of the recording paper 12.

Furthermore, there are no particular restrictions on the recording medium, and various recording media can be used, such as normal paper, a recording medium having an ink receiving layer, or a recording sheet which is permeable to air in the thickness direction, such as processed paper, or a flexible medium which is not permeable to air, such as an OHP sheet, or the like.

Furthermore, in the example described above, an embodiment of the present invention is applied to an image forming apparatus which forms an image only on one side of paper (a so-called single-side image forming apparatus), but the application of the present invention is not limited to this, and it can also be applied in a similar fashion to an image forming apparatus which is able to form an image on both surfaces of paper (a so-called double-side image forming apparatus). Consequently, the front/rear surfaces of the recording medium (recording paper) mentioned in the present application mean the front/rear surfaces of the recording medium during image formation, and the surface on the side where the image is formed is taken to be the front surface of the recording medium.

Image forming methods and image forming apparatuses according to embodiments of the present invention have been described in detail above, but the present invention is not limited to the aforementioned examples, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a first conveyance device which includes a first suctioning surface traveling and having a plurality of first suction holes, places a recording medium in a first prescribed position on the first suctioning surface, and conveys the recording medium in the first prescribed position on the first suctioning surface while suctioning a rear surface of the recording medium via the plurality of first suction holes;

a treatment liquid deposition device which deposits a treatment liquid that aggregates or insolubilizes coloring material of an ink onto a front surface of the recording medium conveyed by the first conveyance device;

a second conveyance device which is provided downstream of the first conveyance device in terms of a conveyance direction in which the recording medium is conveyed, includes a second suctioning surface traveling and having a plurality of second suction holes, places the recording medium in a second prescribed position on the second suctioning surface, and conveys the recording medium in the second prescribed position on the second suctioning surface while suctioning the rear surface of the recording medium via the plurality of second suction holes; and an image forming device which ejects droplets of the ink onto the surface of the recording medium conveyed by the second conveyance device so as to form an image, wherein the first suction holes of the first conveyance device and the second suction holes of the second conveyance device are formed in such a manner that first suction positions on the recording medium which are suctioned by the first suction holes of the first conveyance device and second suction positions on the recording medium which are suctioned by the second suction holes of the second conveyance device are mutually different, and wherein positions where the first suction holes suction the recording medium during deposition of the treatment liquid and positions where the second suction holes suction the recording medium during deposition of ink are staggered completely with respect to each other and do not overlap with each other.

2. The image forming apparatus as defined in claim 1,wherein the first conveyance device and the second conveyance device each have a gripping device which grips an end of the recording medium.

3. The image forming apparatus as defined in claim 1 wherein suctioning force acting via the second suction holes of the second conveyance device is set to be higher than suctioning force acting via the first suction holes of the first conveyance device.

4. An image forming method, comprising the steps of:

placing a recording medium on a first suctioning surface traveling and having a plurality of first suction holes, and conveying the recording medium on the first suctioning surface while suctioning a rear surface of the recording medium via the plurality of first suction holes;

depositing a treatment liquid that aggregates or insolubilizes coloring material of an ink, onto a front surface of the recording medium conveyed by the first suctioning surface;

placing the recording medium on which the treatment liquid is deposited, on a second suctioning surface traveling and having a plurality of second suction holes, and conveying the recording medium on the second suctioning surface while suctioning the rear surface of the recording medium via the plurality of second suction holes; and ejecting droplets of the ink onto the front surface of the recording medium conveyed on the second suctioning surface so as to form an image, wherein first suction positions of the recording medium which are suctioned by the first suction holes of the first suctioning surface and second suction positions of the recording medium which are suctioned by the second suction holes of the second auctioning surface are mutually different, and wherein positions where the first suction holes suction the recording medium and positione where the second suction holes suction the recording medium are staggered completely with respect to each other and do not overlap with each other.

5. The image forming method as defined in claim 4, wherein:

when the recording medium is placed and conveyed on the first suctioning surface, the recording medium is conveyed while being gripped at an end of the recording medium; and when the recording medium is placed and conveyed on the second suctioning surface, the recording medium is conveyed while being gripped at an end of the recording medium.

6. The image forming method as defined in claim 4, wherein suctioning force acting via the second suction holes of the second suctioning, surface is set to be higher than suctioning force acting via the first suction holes of the first suctioning surface.

* * * * *